US011264688B2

(12) United States Patent
Coquet et al.

(10) Patent No.: US 11,264,688 B2
(45) Date of Patent: Mar. 1, 2022

(54) INTERPOSER AND SUBSTRATE INCORPORATING SAME

(71) Applicants: THALES SOLUTIONS ASIA PTE LTD, Singapore (SG); CENTRE NATIONAL DE LA RECHERCHE SCIENTIFIQUE, Paris (FR);

(Continued)

(72) Inventors: Philippe Coquet, Singapore (SG); Beng Kang Tay, Singapore (SG); Mathieu Cometto, Singapore (SG); Dominique Baillargeat, Limoges (FR); Stéphane Bila, Limoges (FR); Kamel Frigui, Limoges (FR); Philippe Ferrari, Grenoble (FR); Emmanuel Pistono, Grenoble (FR); Florence Podevin, Grenoble (FR)

(73) Assignees: THALES SOLUTIONS ASIA PTE LTD, Singapore (SG); CENTRE NATIONAL DE LA RECHERCHE SCIENTIFIQUE, Paris (FR);

(Continued)

( * ) Notice: Subject to any disclaimer, the term of this patent is extended or adjusted under 35 U.S.C. 154(b) by 0 days.

(21) Appl. No.: 16/624,067

(22) PCT Filed: May 23, 2018

(86) PCT No.: PCT/SG2018/050251

§ 371 (c)(1),
(2) Date: Dec. 18, 2019

(87) PCT Pub. No.: WO2018/236286

PCT Pub. Date: Dec. 27, 2018

(65) Prior Publication Data

US 2020/0153074 A1 May 14, 2020

(30) Foreign Application Priority Data

Jun. 23, 2017 (SG) ..... 10201705250Q

(51) Int. Cl.
*H01P 11/00* (2006.01)
*H01P 3/12* (2006.01)

(52) U.S. Cl.
CPC ..... *H01P 3/121* (2013.01); *H01P 11/002* (2013.01)

(58) Field of Classification Search
CPC ..... H01P 3/121; H01P 11/002
See application file for complete search history.

(56) References Cited

U.S. PATENT DOCUMENTS 3,292,115 A 12/1966 La Rosa
6,137,161 A 10/2000 Gilliland et al.
(Continued)

FOREIGN PATENT DOCUMENTS

FR 3009431 A1 2/2015

OTHER PUBLICATIONS

Serrano A., et al., "Modeling and Characterization of Slow-Wave Microstrip Lines on Metallic-Nanowire-Filled-Membrane Substrate," IEEE Trans. on Microw. Theory Tech., vol. 62, No. 12, Dec. 2014, pp. 3249-3254.

(Continued)

*Primary Examiner* — Dinh T Le
(74) *Attorney, Agent, or Firm* — Dinsmore & Shohl, LLP

(57) ABSTRACT

An interposer (16) and a substrate (10) incorporating the interposer (16) are provided. The interposer (16) includes one or more layers (18) and a cavity (20) defined in the one or more layers (18), the cavity (20) being configured as a waveguide for propagation of electromagnetic waves.

11 Claims, 26 Drawing Sheets

(71) Applicants: UNIVERSITE GRENOBLES ALPES, Saint Martin d'Hères (FR);L'INSTITUT POLYTECHNIQUE DE GRENOBLE, Grenoble (FR); UNIVERSITÉ DE LILLE, Lille (FR); UNIVERSITÉ DE LIMOGES, Limoges (FR); NANYANG TECHNOLOGICAL UNIVERSITY, Singapore (SG)

(73) Assignees: UNIVERSITE GRENOBLES ALPES, Saint Martin d'Hères (FR);L'INSTITUT POLYTECHNIQUE DE GRENOBLE, Grenoble (FR); UNIVERSITE DES SCIENCES ET TECHNOLOGIES DE LILLE 1, Lille (FR); UNIVERSITÉ DE LIMOGES, Limoges (FR); NANYANG TECHNOLOGICAL UNIVERSITY, Singapore (SG)

(56) References Cited

U.S. PATENT DOCUMENTS

| | | | | |
|---|---|---|---|---|
| 6,529,646 | B1 * | 3/2003 | Wight | G02F 1/0356 385/1 |
| 7,650,049 | B2 * | 1/2010 | David | G02F 1/365 385/1 |
| 7,756,503 | B2 * | 7/2010 | Tamaki | H01L 23/66 455/313 |
| 7,952,194 | B2 | 5/2011 | Nair et al. | |
| 9,279,937 | B2 * | 3/2016 | Roh | G02B 6/12 |
| 9,490,240 | B2 * | 11/2016 | Lucero | G02B 6/4239 |
| 2003/0146017 | A1 * | 8/2003 | Fan | H05K 7/1061 174/138 G |
| 2009/0224857 | A1 | 9/2009 | Fujita | |
| 2009/0224858 | A1 | 9/2009 | Fujita | |
| 2011/0018657 | A1 | 1/2011 | Cheng et al. | |
| 2011/0254124 | A1 | 10/2011 | Nalla et al. | |
| 2013/0257564 | A1 | 10/2013 | Huang et al. | |
| 2015/0016068 | A1 | 1/2015 | Liao et al. | |

OTHER PUBLICATIONS

Franck P., et al. "Mesoscopic model for the electromagnetic properties of arrays of nanotubes and nanowires: A bulk equivalent approach" IEEE Trans. on Nanotech., vol. 11, No. 5, Jul. 2012, pp. 964-974.

Niembro-Martin et al., "Slow-Wave Substrate Integrated Waveguide"—IEEE Trans. on Microw. Theory Tech., vol. 62, No. 8, Aug. 2014, pp. 1625-1633.

Cometto M. et al., "Dispositifs millimétriques passifs à ondes lentes à base de nanotubes de carbone," Journées Nationales Microondes (JNM 2015), Jun. 2015, Bordeaux, France.

Pistono, E., "Miniaturisation et intégration de circuits aux radiofréquences et fréquences millimétriques", Memoire d'Habilitation à Diriger des Recherches, Université de Grenoble—Alpes, Nov. 2015, pp. 123-124, Grenoble, France.

Rahimi A. et al., "In-Substrate Resonators and Bandpass Filters with Improved Insertion Loss in Kband Utilizing Low Loss Glass Interposer Technology and Superlattic Conductors," Proceedings of 2016 IEEE 66th Electronic Components and Technology Conference, May 2016, pp. 1322-1238.

Tong J. et al., "Substrate-Integrated Waveguides in Glass Interposers with Through-Package-Vias"—2015 IEEE Electronic Components & Technology Conference, May 2015, pp. 2222-2227.

Gennadiy I. et. al, "Full-Wave Modal Analysis of the Rectangular Waveguide Gathering", IEEE Transactions on Plasma Science, IEEE Service Center, Jun. 2000, p. 614, vol. 28, No. 3.

International Search Report dated Oct. 8, 2018 in reference to co-pending International Application No. PCT/SG2018/050251.

European Office Action dated Sep. 21, 2002 in related European Application No. 18733701.9-1205.

* cited by examiner

INTERPOSER AND SUBSTRATE INCORPORATING SAME

FIELD OF THE INVENTION

The present invention relates to the field of microelectronics and more particularly to an interposer and a substrate incorporating the same.

BACKGROUND OF THE INVENTION

Miniaturisation demands have resulted in a number of issues such as, for example, an increase in integrated circuit density, electromagnetic interference and size constraints.

It is therefore desirable to provide an interposer that can alleviate some miniaturisation issues and a substrate incorporating such an interposer.

SUMMARY OF THE INVENTION

Accordingly, in a first aspect, the present invention provides an interposer including one or more layers and a cavity defined in the one or more layers, the cavity being configured as a waveguide for propagation of electromagnetic waves.

In a second aspect, the present invention provides a substrate including first substrate layer, a second substrate layer, and an interposer in accordance with the first aspect between the first and second substrate layers.

Other aspects and advantages of the invention will become apparent from the following detailed description, taken in conjunction with the accompanying drawings, illustrating by way of example the principles of the invention.

BRIEF DESCRIPTION OF THE DRAWINGS

Embodiments of the invention will now be described, by way of example only, with reference to the accompanying drawings, in which.

DETAILED DESCRIPTION OF EXEMPLARY EMBODIMENTS

Figure 1A:
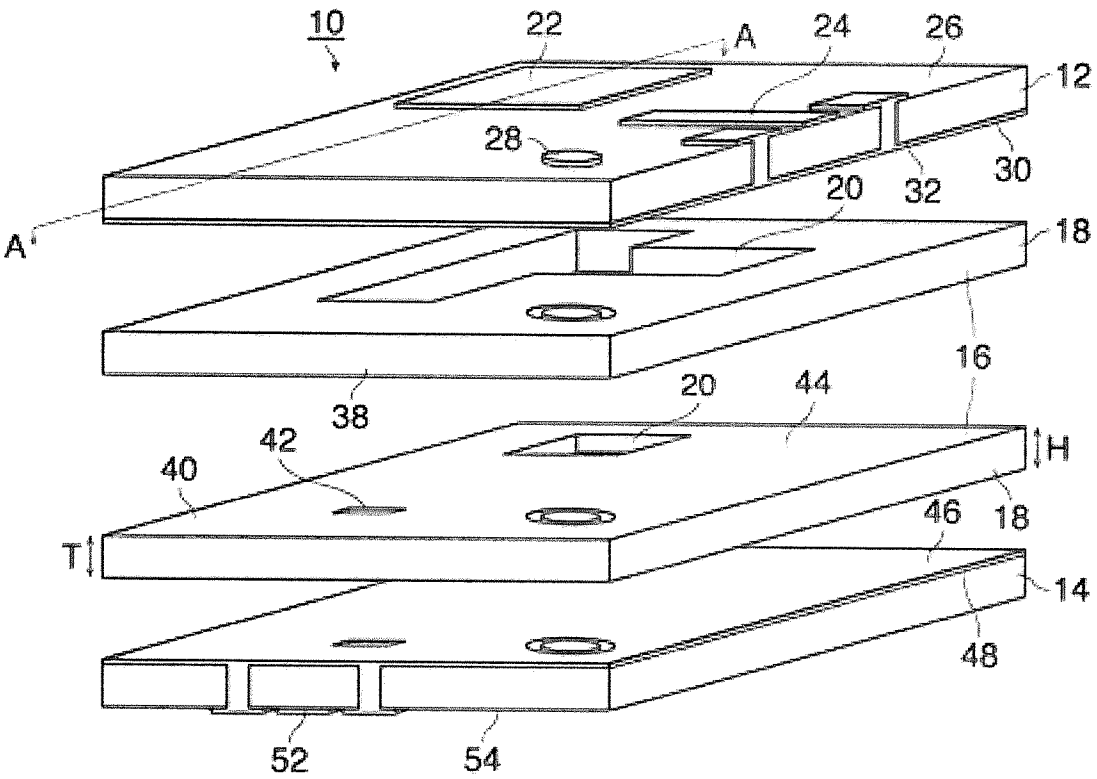
FIG. 1A is a schematic exploded view of a substrate incorporating an interposer in accordance with an embodiment of the present invention.
Figure 1B:
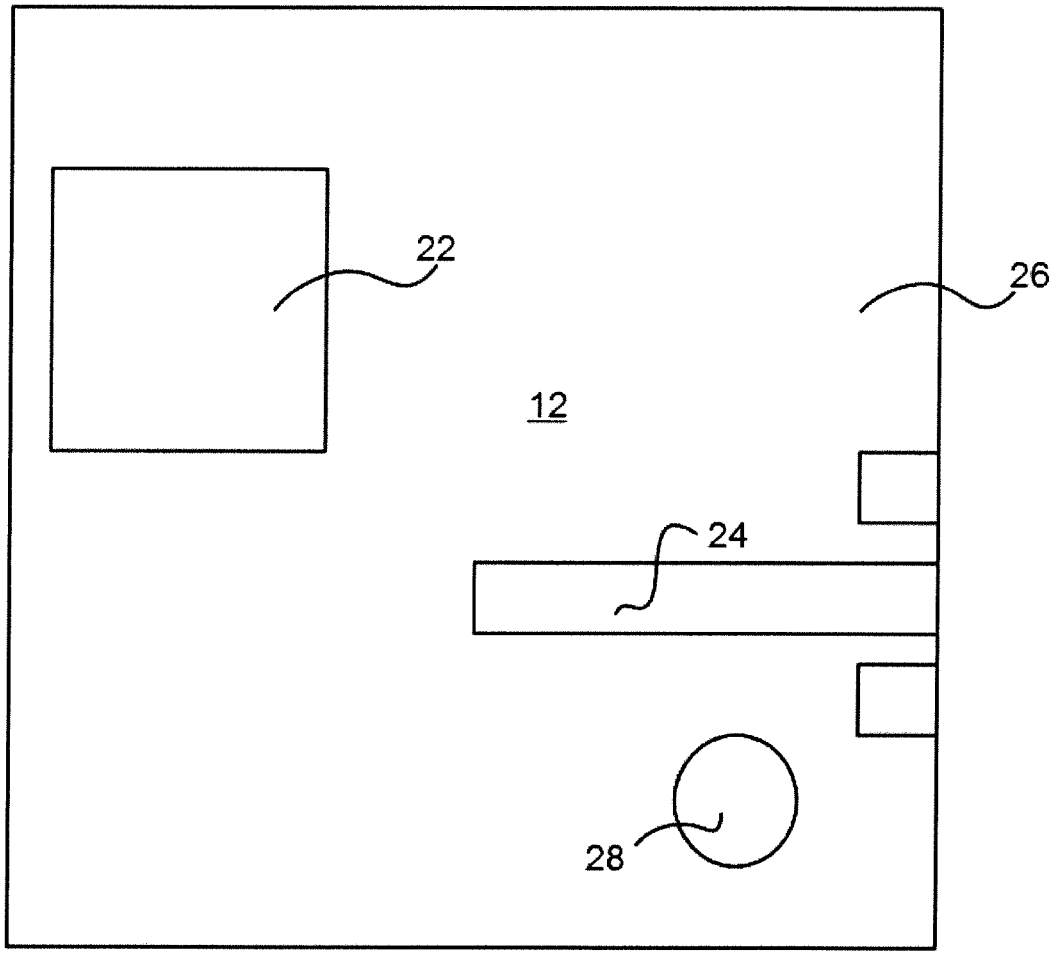
FIG. 1B is a schematic top plan view of a first substrate layer of the substrate of FIG. 1A.
Figure 1C:
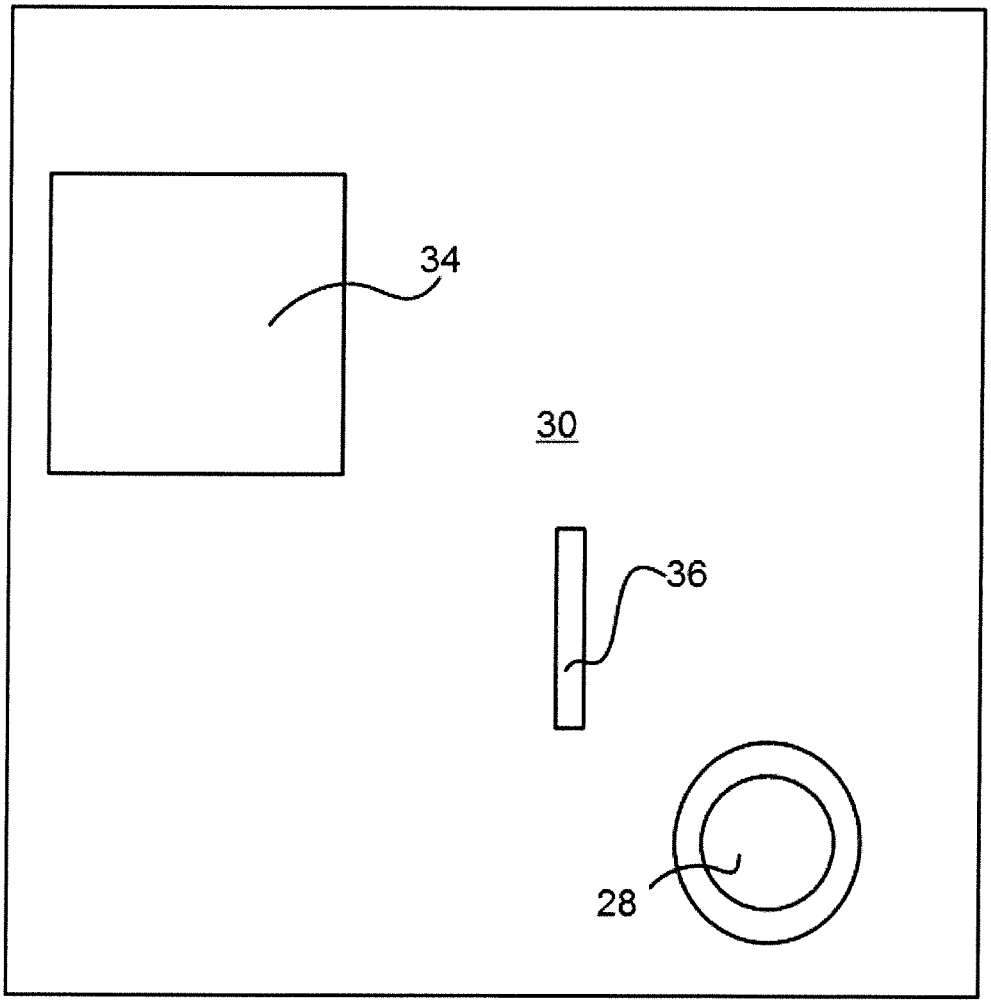
FIG. 1C is a schematic top plan view of a first electrically conductive layer of the substrate of FIG. 1A.
Figure 1D:
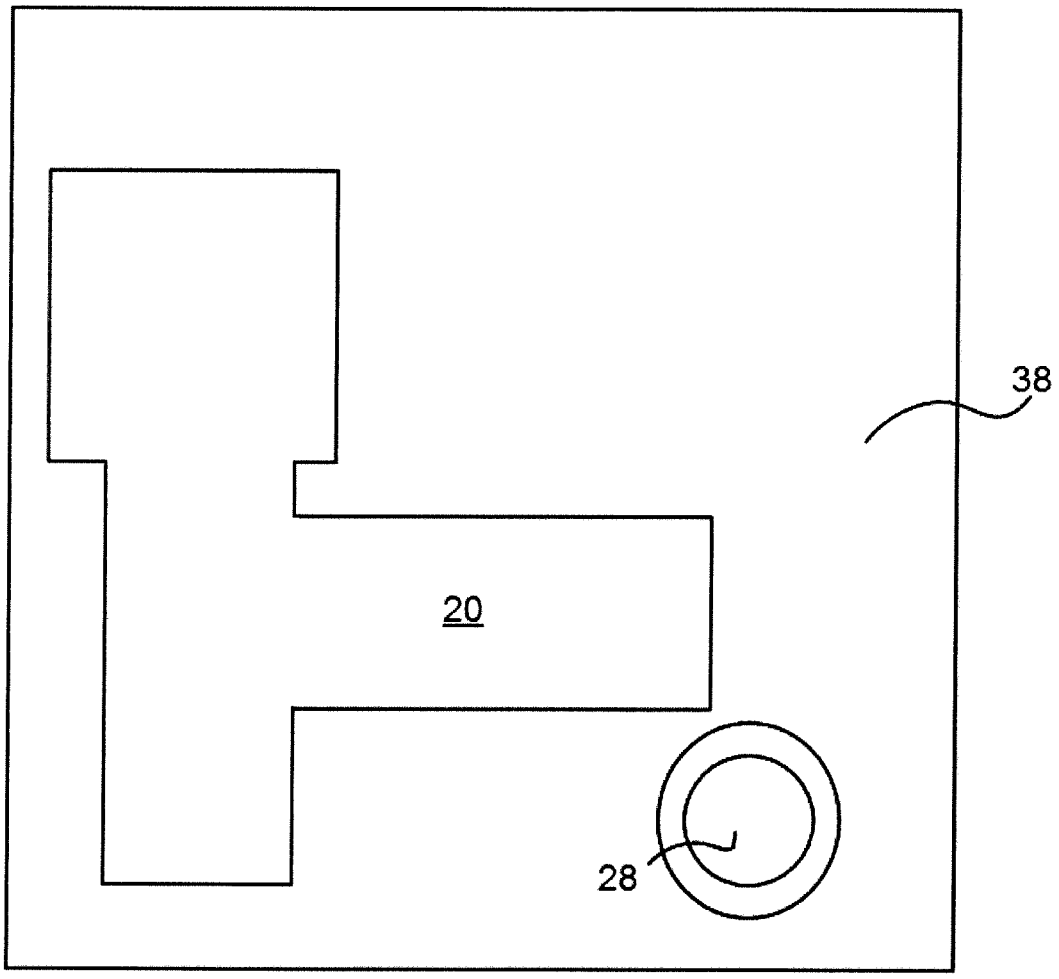
FIG. 1D is a schematic top plan view of a first interposer layer of the substrate of FIG. 1A.
Figure 1E:
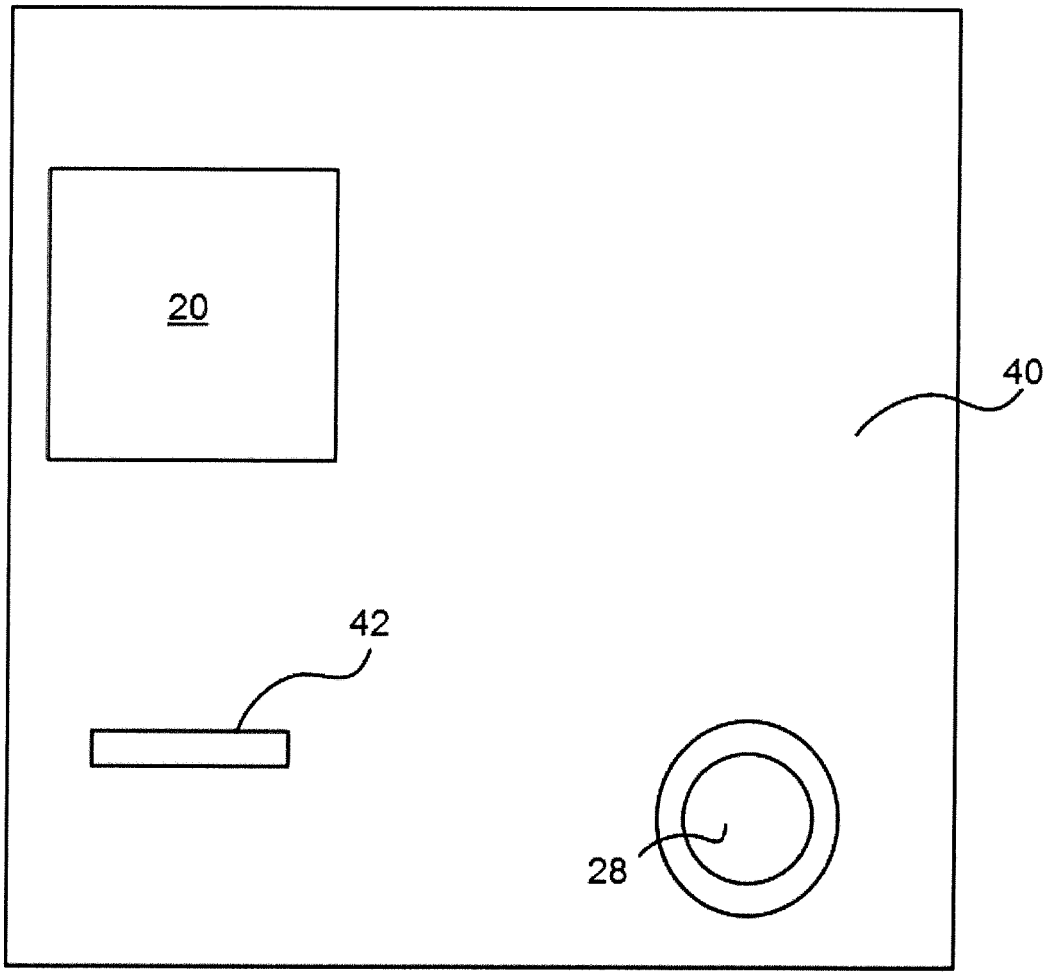
FIG. 1E is a schematic top plan view of a second interposer layer of the substrate of FIG. 1A.
Figure 1F:
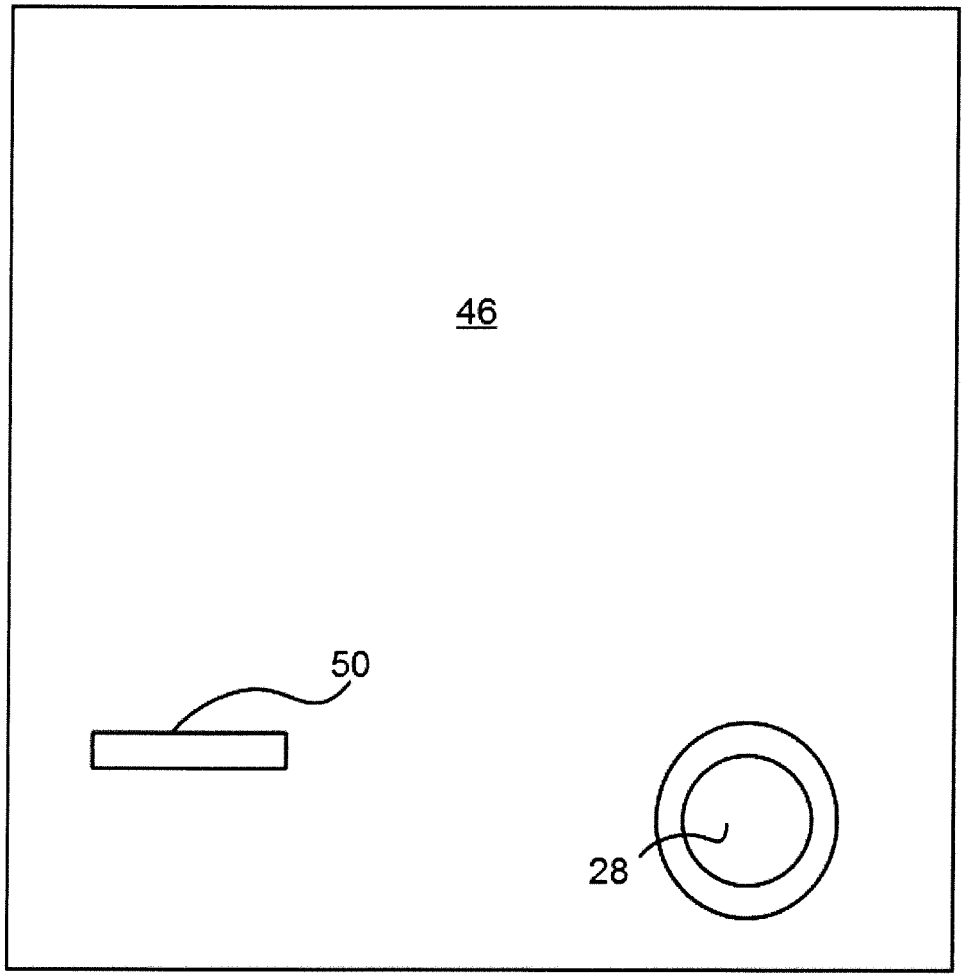
FIG. 1F is a schematic top plan view of a second electrically conductive layer of the substrate of FIG. 1A.

The detailed description set forth below in connection with the appended drawings is intended as a description of presently preferred embodiments of the invention, and is not intended to represent the only forms in which the present invention may be practiced. It is to be understood that the same or equivalent functions may be accomplished by different embodiments that are intended to be encompassed within the scope of the invention.

Referring now to FIGS. 1A through 1H, a substrate 10 is shown. The substrate 10 includes a first substrate layer 12, a second substrate layer 14 and an interposer 16 between the first and second substrate layers 12 and 14. The interposer 16 includes a plurality of layers 18 and a cavity 20 is defined in the layers 18, the cavity 20 being configured as a waveguide for propagation of electromagnetic waves.

In the embodiment shown, an antenna 22 and a first transmission line 24 are provided on a first surface 26 of the first substrate layer 12 and a via 28 extends through the first substrate layer 12, the second substrate layer 14 and the interposer 16. The first substrate layer 12 may be made of a dielectric material such as, for example, alumina, silicon, quartz, FR4 or polytetrafluoroethylene (PTFE), while the antenna 22 and the first transmission line 24 may be made of gold or other electrically conductive material. In the present embodiment, the via 28 is provided for direct current (DC) signals and may include a plurality of graphene layers for thermal management purposes.

In the embodiment shown, a first electrically conductive layer 30 is provided on a second surface 32 of the first substrate layer 12. As can be seen from FIG. 1C, the first electrically conductive layer 30 is provided with a first opening 34 beneath the antenna 22 and a second opening 36 beneath the first transmission line 24. The first electrically conductive layer 30 may be made of gold or other electrically conductive material.

The interposer 16 of the present embodiment includes a first interposer layer 38 and a second interposer layer 40. As can be seen from FIG. 1D, the portion of the cavity 20 defined in the first interposer layer 38 is configured as a power splitter supporting electromagnetic wave propagation to the antenna 22 and the first transmission line 24. Correspondingly, as can be seen from FIG. 1E, the portion of the cavity 20 defined in the second interposer layer 40 is configured to provide a larger propagation volume underneath the antenna 22 and a slot 42 for electromagnetic excitation. In the present embodiment, the second interposer layer 40 having the slot 42 is provided to produce slow wave effect inside the interposer 16 and thereby advantageously allows for a reduction in the length and/or the width of the interposer 16. More particularly, provision of the second interposer layer 40 with the slot 42 in the interposer 16 increases permittivity and creates slow wave propagation which in turn reduces the size requirements of the cavity 20. In this manner, a slow-wave structure is provided in one of the layers 18, the slow-wave structure being in communication with the waveguide. More particularly, the slow-wave structure of the present embodiment includes the slot 42 defined in the second interposer layer 40.

Although the interposer 16 in the embodiment shown is made up of two (2) layers 18, it should be understood by persons of ordinary skill in the art that the present invention is not limited by the number of layers making up the interposer 16. In alternative embodiments, the interposer may be made up of one (1) or more layers 18. Furthermore, as will be understood by persons of ordinary skill in the art, the present invention is also not limited by the arrangement of the layers 18. For example, an interposer layer incorporating a slow-wave structure may be provided above one or more waveguide interposer layers in an alternative embodiment (see, for example, FIG. 4A described below). In yet another embodiment, one or more waveguide interposer layers may be sandwiched between two (2) layers having slow-wave structures to distribute the slow wave effect (see, for example, FIG. 3A described below).

In the present embodiment, each of the layers 18 of the interposer 16 is formed of a plurality of nanostructures 44. The nanostructures 44 of the present embodiment are elongate in shape and are arranged in parallel orientation to one another in each of the layers 18. In the embodiment shown, a height H of the nanostructures 44 in each layer 18 corresponds to a thickness T of the each layer 18. The nanostructures 44 may be carbon nanotubes or metallic nanowires. The carbon nanotubes or metallic nanowires may be single-walled or multi-walled. Advantageously, when made of carbon nanotubes or metallic nanowires, the interposer 16 is also able to perform thermal management functions, provide electromagnetic shielding, achieve high quality factor, avoid radiation losses and facilitate slow wave propagation. Further advantageously, such an interposer may be fabricated, for example, using low-cost yet reliable carbon nanotube production processes. For example, the interposer 16 may be etched or patterned using standard carbon nanotube or nanowire growth processes, lithography methods or transfer methods. In alternative embodiments, three-dimensional (3D) printing methods or micromachining may be employed to form the interposer 16.

In the embodiment shown, a second electrically conductive layer 46 is provided on a first surface 48 of the second substrate layer 14. As can be seen from FIG. 1F, the second electrically conductive layer 46 is provided with a third opening 50 beneath the slot 42 in the second interposer layer 40. The second electrically conductive layer 46 may be made of gold or other electrically conductive material.

Figure 1G:
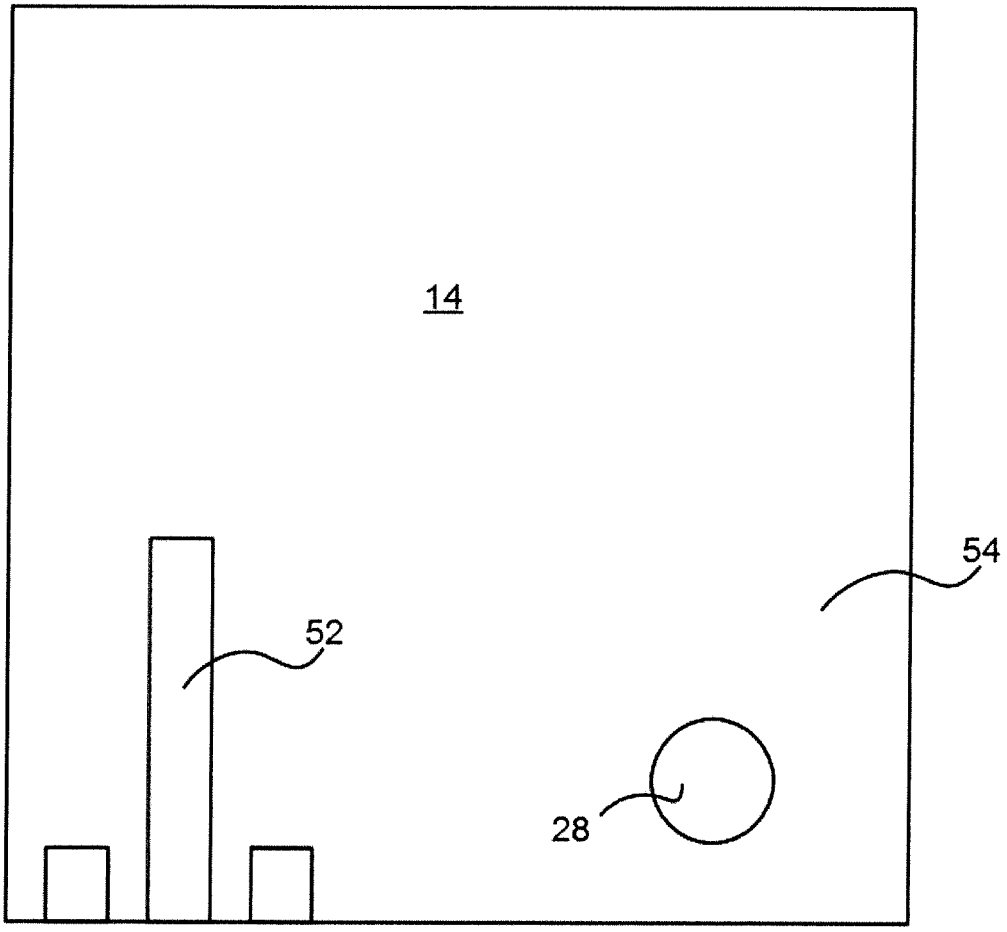
FIG. 1G is a schematic bottom plan view of a second substrate layer of the substrate of FIG. 1A.

As can be seen from FIG. 1G, a second transmission line 52 is provided on a second surface 54 of the second substrate layer 14 in the present embodiment. The second substrate layer 14 may be made of a dielectric material such as, for example, alumina, quartz, silicon, FR4 or polytetrafluoroethylene (PTFE), while the second transmission line 52 may be made of gold or other electrically conductive material.

Figure 1H:
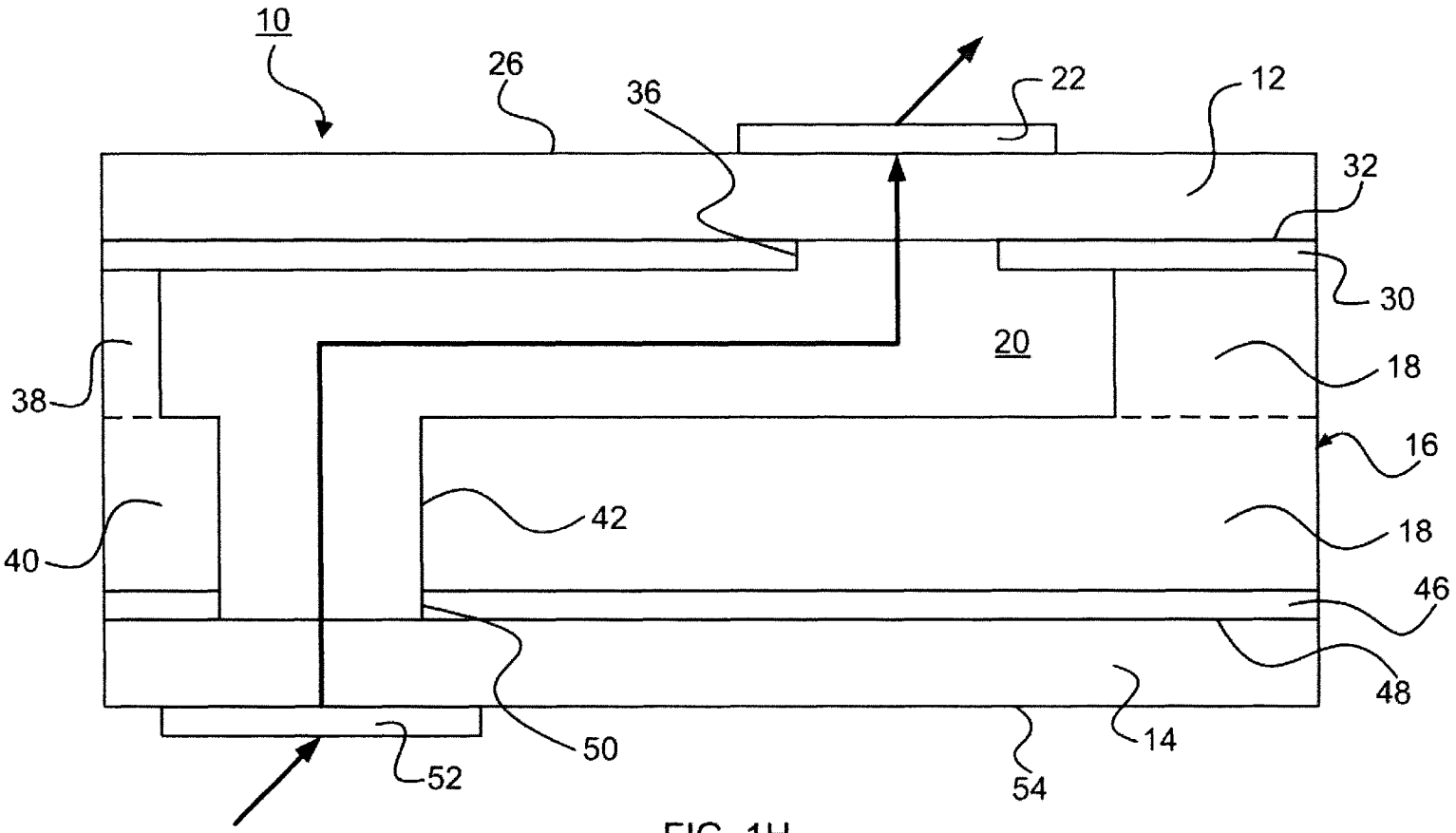
FIG. 1H is a schematic cross-sectional view of the substrate of FIG. 1A along a line A-A.

Referring now to FIGS. 1A and 1H, when in operation, electromagnetic waves propagate from the second transmission line 52 through the embedded air cavity 20 in the interposer 16 to the antenna 22 and the first transmission line 24.

In the present embodiment, the interposer 16 acts not only as a traditional interposer realizing vertical connections via, for example, the via 28, but rather as a functionalized interposer 16 providing a smart substrate 10 within which electromagnetic wave propagation and one or more passive devices necessary to microwave signal processing and management are realized in an embedded air cavity 20 with electromagnetic shielding. More particularly, with the embedded air cavity 20, radio frequency passive functions are gathered inside the interposer 16, allowing for electromagnetic shielding whilst avoiding radiation losses. Moreover, having air as the propagating medium allows for low loss propagation and high quality factors and thermal dissipation of high power electromagnetic transmission is enhanced due to the good thermal conductivity of the nanotubes. Further advantageously, the width of the via 28 is substantially reduced due to the ability to create vias with aspect-ratios of greater than 20 using carbon nanotubes and the size of the interposer 16 and consequently the substrate 10 may also be reduced through the implementation of slow wave technology.

Figure 2A:
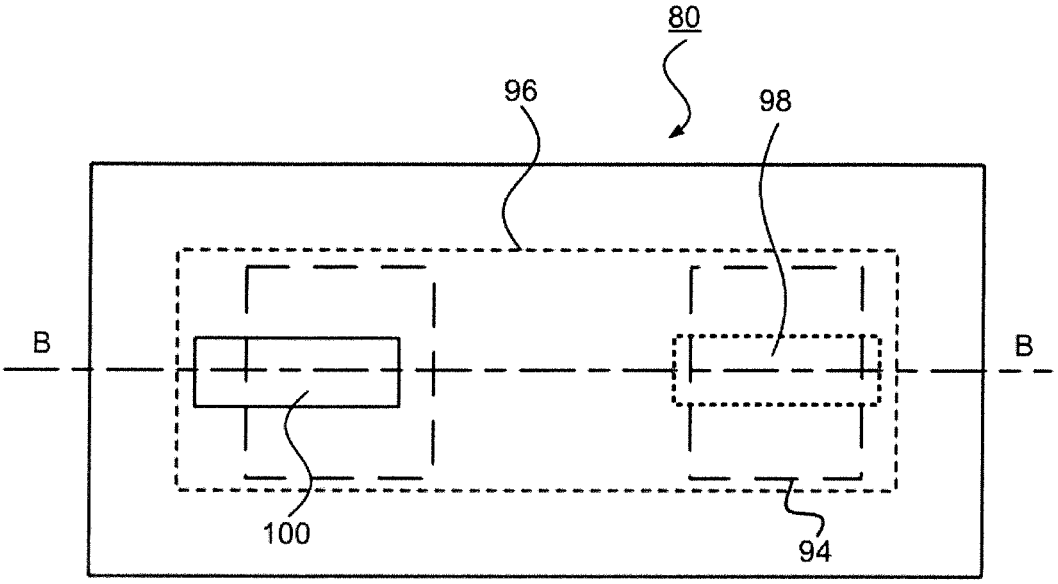
FIG. 2A is a schematic top plan view of a substrate or waveguide structure incorporating an interposer in accordance with another embodiment of the present invention.
Figure 2B:
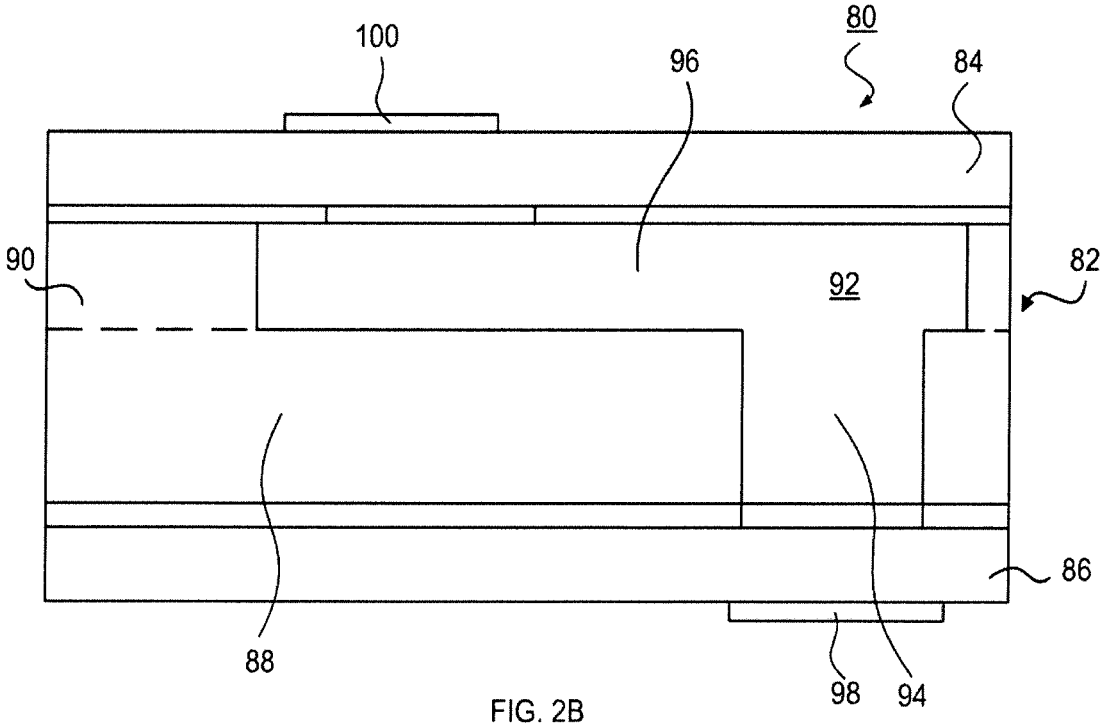
FIG. 2B is a schematic cross-sectional view of the substrate or waveguide structure of FIG. 2A along a line B-B.

Referring now to FIGS. 2A and 2B, a substrate or waveguide structure 80 incorporating an interposer 82 in accordance with another embodiment of the present invention is shown. The substrate or waveguide structure 80 includes a first substrate layer 84, a second substrate layer 86 and the interposer 82 between the first and second substrate layers 84 and 86. In the present embodiment, the interposer 16 includes a first interposer layer 88 and a second interposer layer 90 coupled to the first interposer layer 88. A cavity 92 is defined in the first and second interposer layers 88 and 90, the cavity 92 being configured as a waveguide for propagation of electromagnetic waves. In the present embodiment, the cavity 92 includes a slot 94 defined in the first interposer layer 88 and a channel waveguide 96 defined in the second interposer layer 90, the slot 94 being in communication with the channel waveguide 96. When in operation, electromagnetic waves propagate from the first excitation line 98 through the slot 94 and the channel waveguide 96 in the interposer 82 to a second excitation line 100.

Figure 3A:
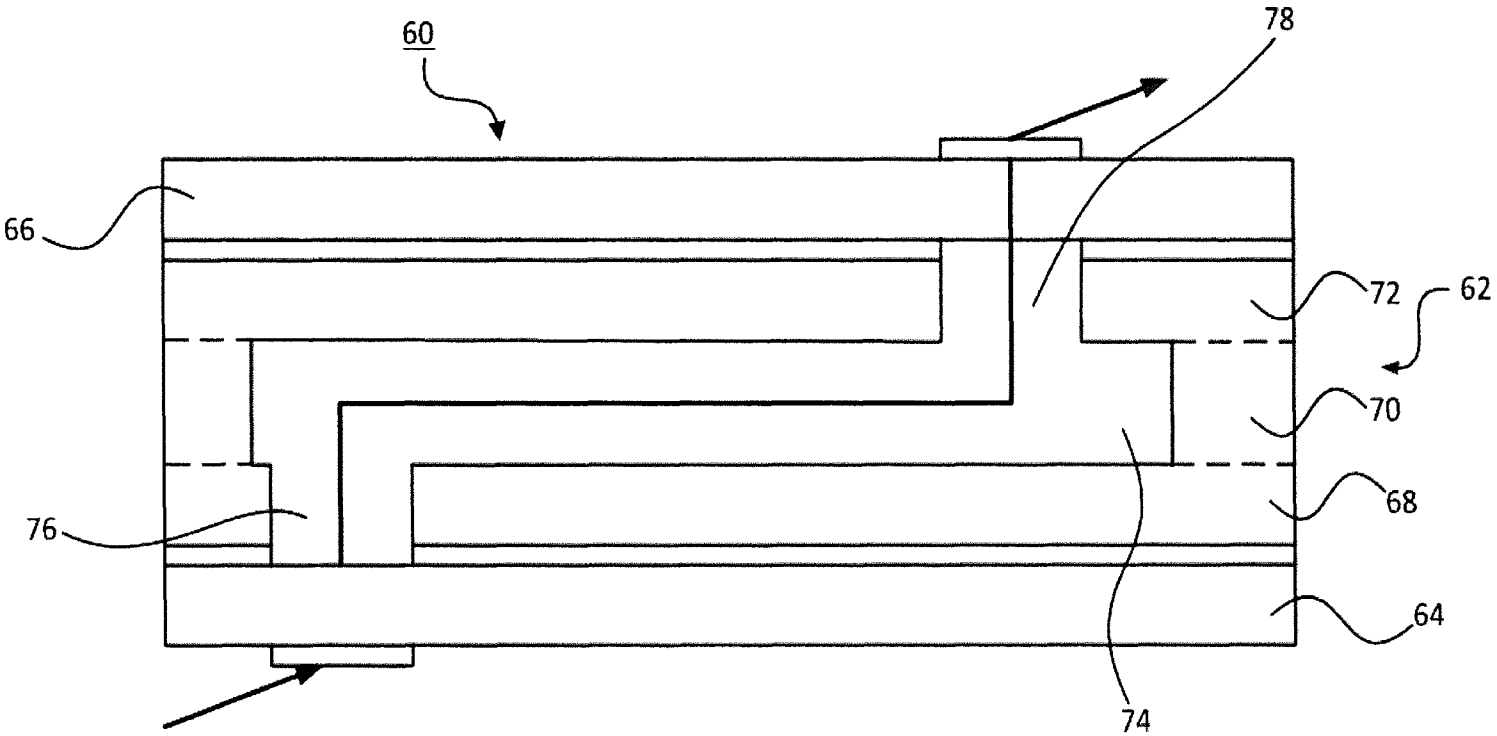
FIG. 3A is a schematic cross-sectional view of a substrate or waveguide structure incorporating an interposer in accordance with yet another embodiment of the present invention.
Figure 3B:
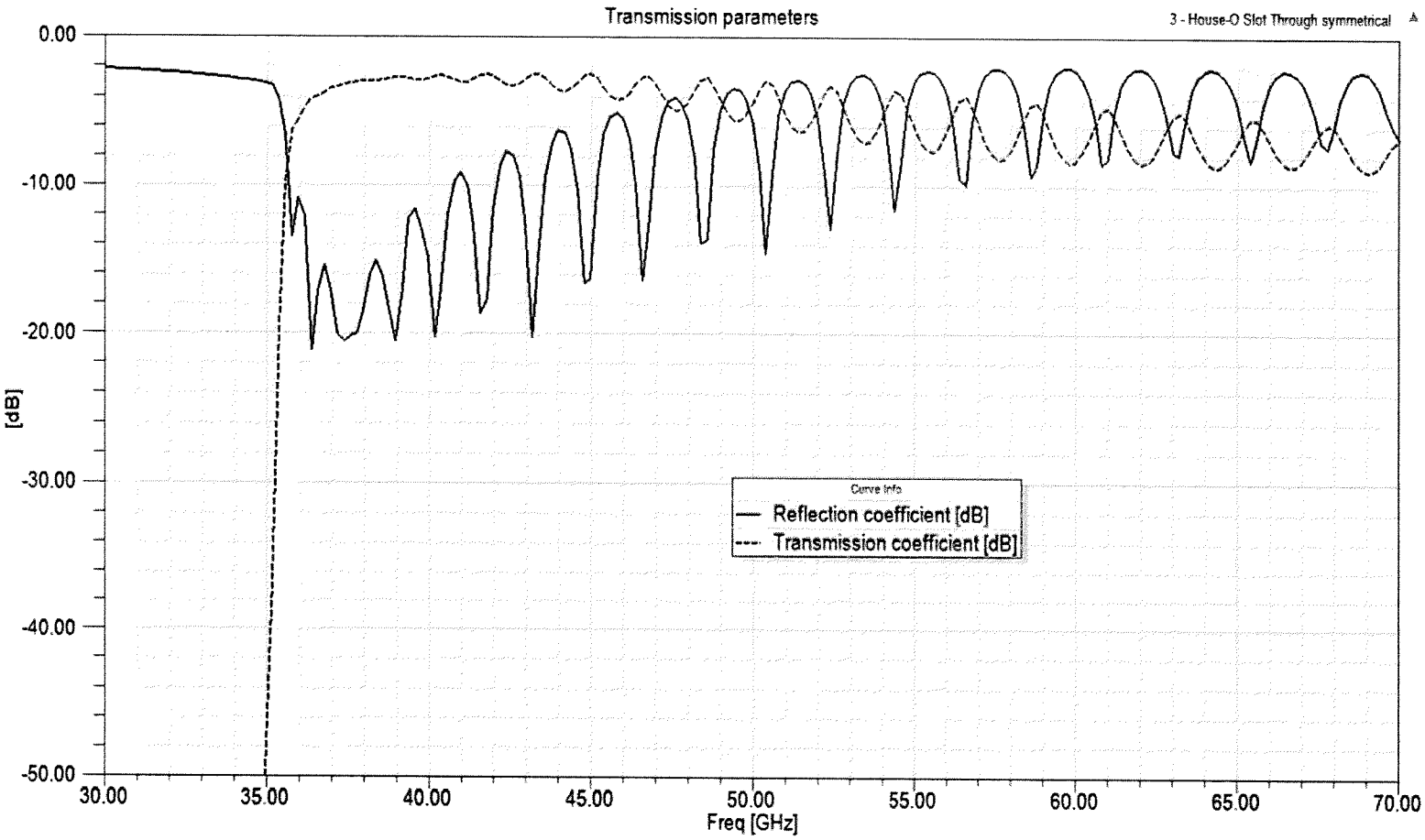
FIG. 3B is a graph of the reflection and transmission coefficients of the substrate or waveguide structure of FIG. 3A.

Referring now to FIGS. 3A and 3B, a substrate or waveguide structure 60 incorporating an interposer 62 in accordance with yet another embodiment of the present invention is shown. The substrate or waveguide structure 60 includes a first substrate layer 64, a second substrate layer 66 and the interposer 62 between the first and second substrate layers 64 and 66. In the present embodiment, the interposer 62 includes a first layer 68, a second layer 70 and a third layer 72. A cavity 74 is defined in the second layer 70, the cavity 74 being configured as a waveguide for propagation of electromagnetic waves. In the present embodiment, a slow-wave structure in the form of a first slot 76 defined in the first layer 68 and a second slot 78 defined in the third layer 72 is provided in the first and third layers 68 and 72, the slow-wave structure being in communication with the waveguide.

A simulation was performed on the substrate or waveguide structure 60 and the recorded reflection and transmission coefficients are shown in FIG. 3B. The results of the simulation demonstrate that a cut-off at a lower frequency of about 35 Gigahertz (GHz) is attainable with the substrate or waveguide structure 60 and the interposer 62 of the present embodiment.

Figure 4A:
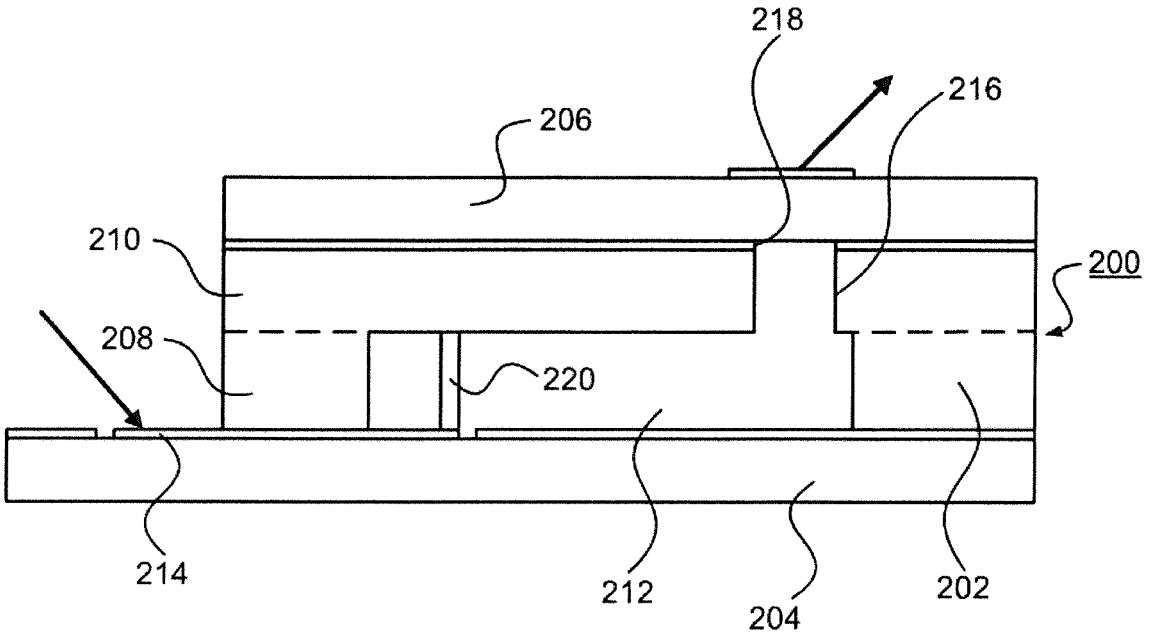
FIG. 4A is a schematic cross-sectional view of a waveguide structure incorporating an interposer in accordance with still another embodiment of the present invention.
Figure 4B:
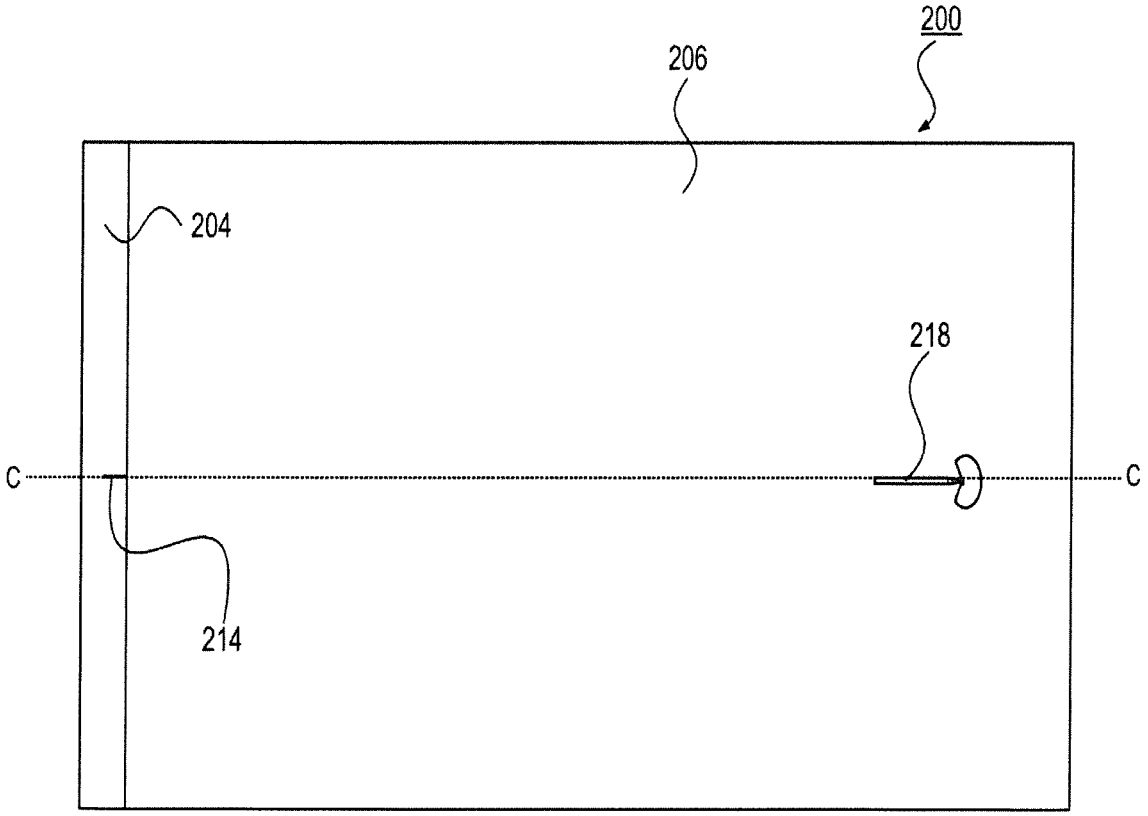
FIG. 4B is a schematic top plan view of the waveguide structure of FIG. 4A along a line C-C.
Figure 4C:
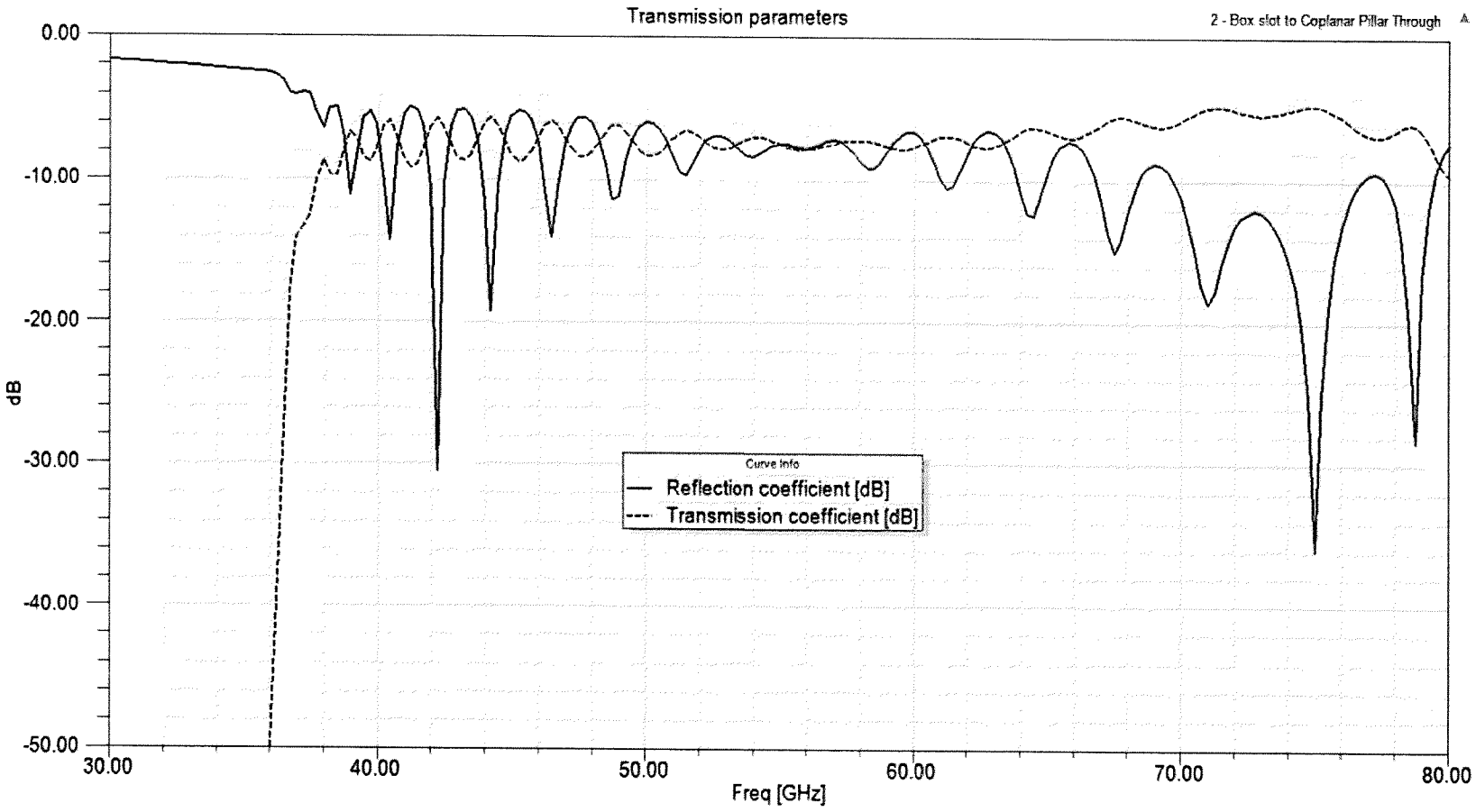
FIG. 4C is a graph of the reflection and transmission coefficients of the waveguide structure of FIG. 4A.

Referring now to FIGS. 4A through 4C, a waveguide structure 200 incorporating an interposer 202 in accordance with still another embodiment of the present invention is shown. The waveguide structure 200 includes a first substrate layer 204, a second substrate layer 206 and the interposer 202 between the first and second substrate layers 204 and 206. The interposer 202 includes a first layer 208 and a second layer 210. A cavity 212 is defined in the first layer 208, the cavity 212 being configured as a waveguide for propagation of electromagnetic waves. In the present embodiment, a coplanar line 214 is provided on the first substrate layer 204, a first slot 216 is defined in the second layer 210, a second slot 218 is provided with the second substrate layer 206, and an antenna 220 is provided in the cavity 212. When in operation, electromagnetic waves propagate from the antenna 220 through the cavity 212 in the interposer 202 and then through the first and second slots 216 and 218. Advantageously, the provision of the coplanar line 214 and the second slot 218 on the same side of the waveguide structure 200 facilitates testing of the waveguide structure. In the present embodiment, the antenna 216 is an excitation pillar. In an alternative embodiment, the antenna provided in the cavity 210 may be a slot, a planar antenna or a coaxial.

A simulation was performed on the waveguide structure 200 and the recorded reflection and transmission coefficients are shown in FIG. 4C. The results of the simulation demonstrate that a cut-off at a lower frequency of about 36 Gigahertz (GHz) is attainable with the waveguide structure 200 and the interposer 202 of the present embodiment.

Figure 5:
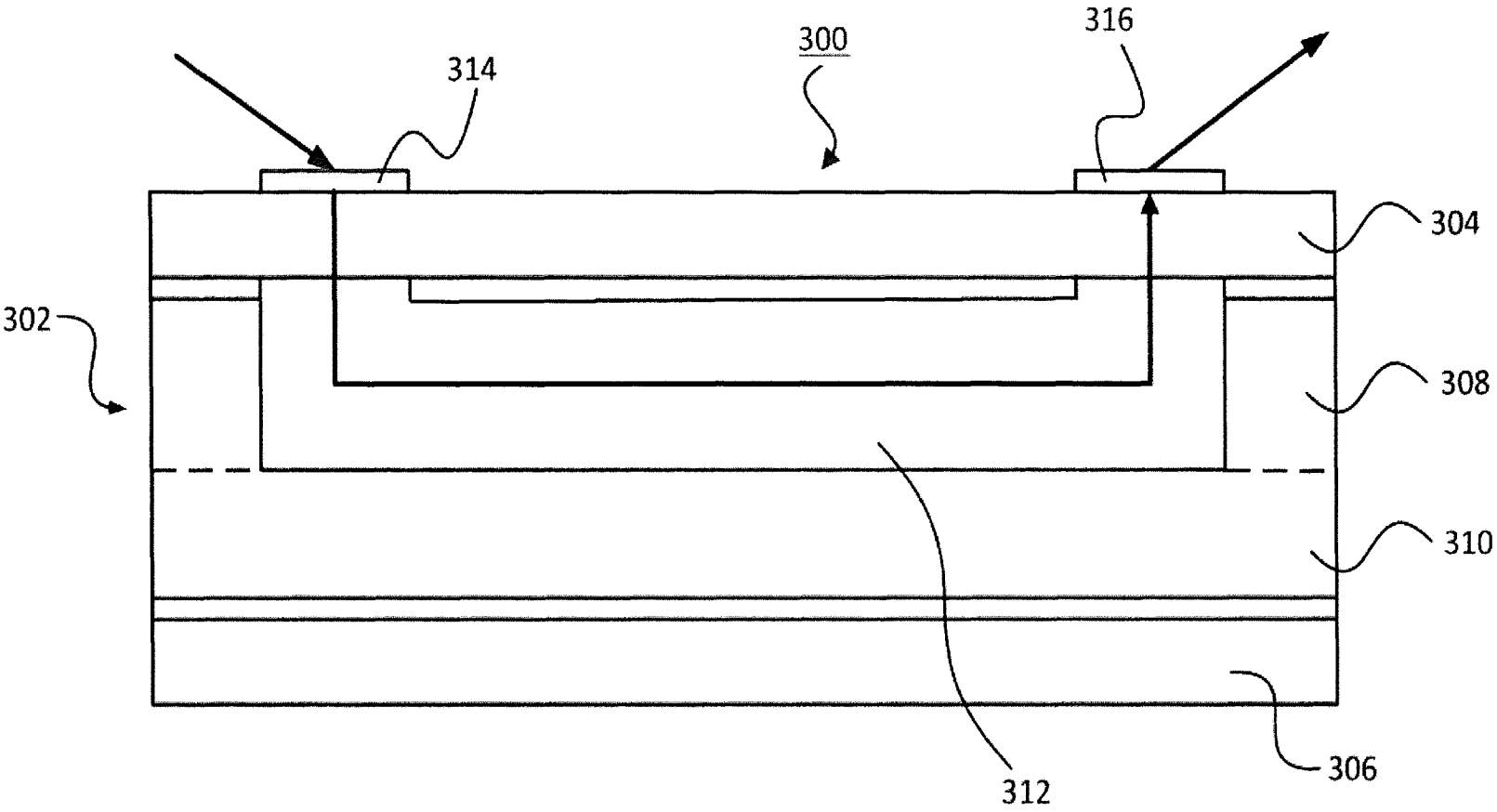
FIG. 5 is a schematic cross-sectional view of a substrate or waveguide structure incorporating an interposer in accordance with yet another embodiment of the present invention.

Referring now to FIG. 5, a substrate or waveguide structure 300 incorporating an interposer 302 in accordance with yet another embodiment of the present invention is shown. The substrate or waveguide structure 300 includes a first substrate layer 304, a second substrate layer 306 and the interposer 302 between the first and second substrate layers 304 and 306. In the present embodiment, the interposer 302 includes a first layer 308 and a second layer 310. A cavity 312 is defined in the first layer 308, the cavity 312 being configured as a waveguide for propagation of electromagnetic waves. In the present embodiment, a first transmission line 314 and a second transmission line 316 are provided on the first substrate layer 304. When in use, electromagnetic waves propagate from the first transmission line 314 through the embedded cavity 312 in the interposer 302 to the second transmission line 316. In other words, input and output take place are on the same side of the substrate or waveguide structure 300 in the present embodiment.

Referring now to FIGS. 6 through 15, interposers having different cavity shapes and consequently providing different types of passive microwave functionalities such as, for example, attenuation, phase shifting, filtering, coupling and power division will now be described below. As can be seen from FIGS. 6 through 15, the cavity defined in the one or more layers of an interposer may be configured to include one or more of a splitter, a coupler, an antenna feed, a filter, a phase shifter and a crossover.

Figure 6:
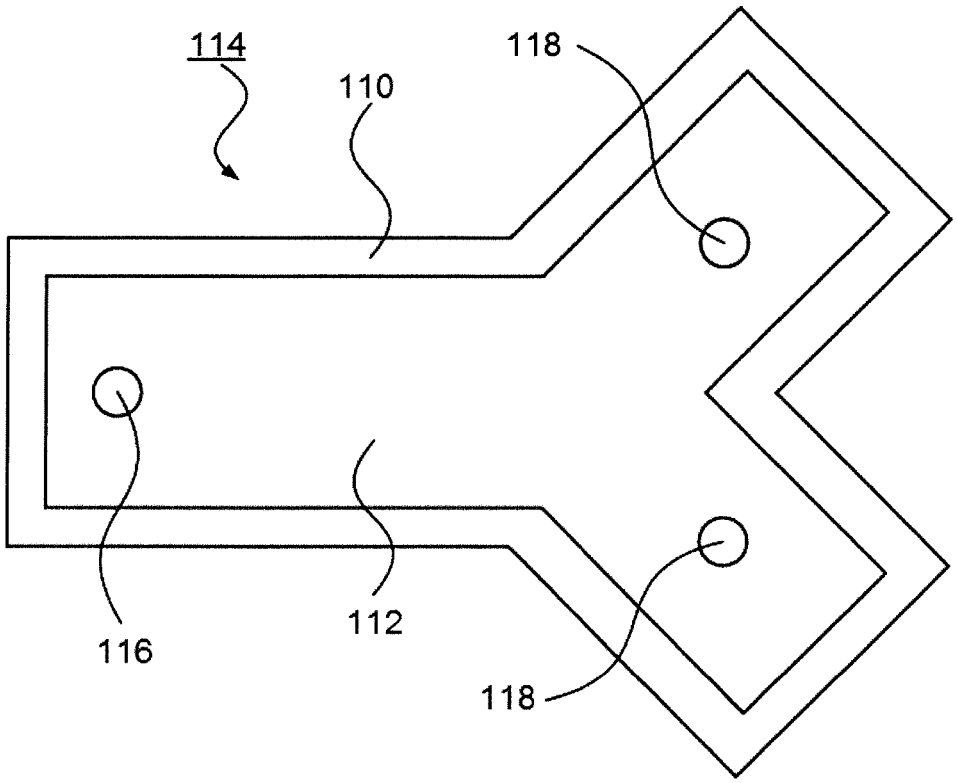
FIG. 6 is a schematic top plan view of an interposer in accordance with one embodiment of the present invention.

Referring now to FIG. 6, an interposer 110 having a cavity 112 configured to include a Y-splitter 114 is shown. In the embodiment shown, an input antenna 116 and a plurality of output antennas 118 are provided in the cavity 112. The Y-splitter 114 may be provided in a single layer of the interposer 110.

Figure 7:
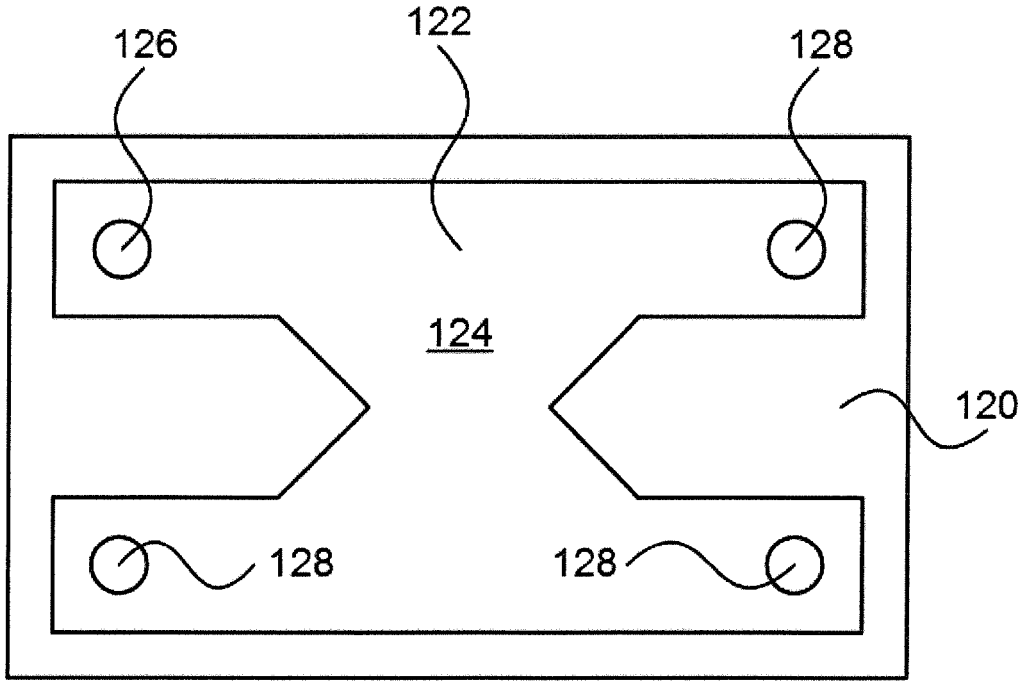
FIG. 7 is a schematic top plan view of an interposer in accordance with another embodiment of the present invention.

Referring now to FIG. 7, an interposer 120 having a cavity 122 configured to include a four-way coupler 124 is shown. In the embodiment shown, an input antenna 126 and a plurality of output antennas 128 are provided in the cavity 122. The four-way coupler 124 may be provided in a single layer of the interposer 120.

Figure 8A:
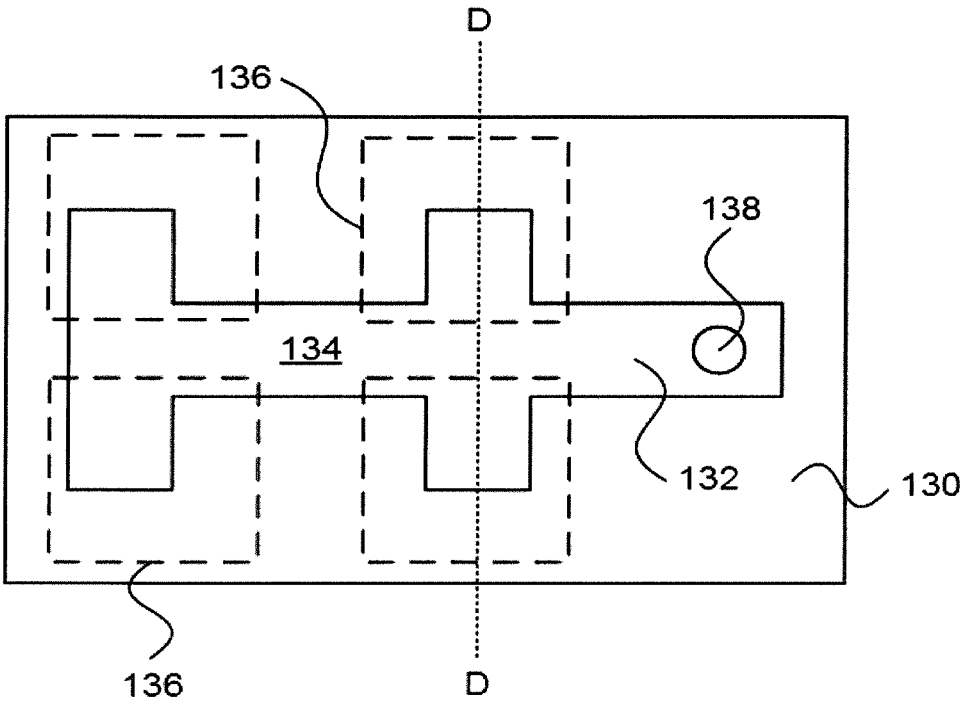
FIG. 8A is a schematic top plan view of an interposer in accordance with yet another embodiment of the present invention.
Figure 8B:
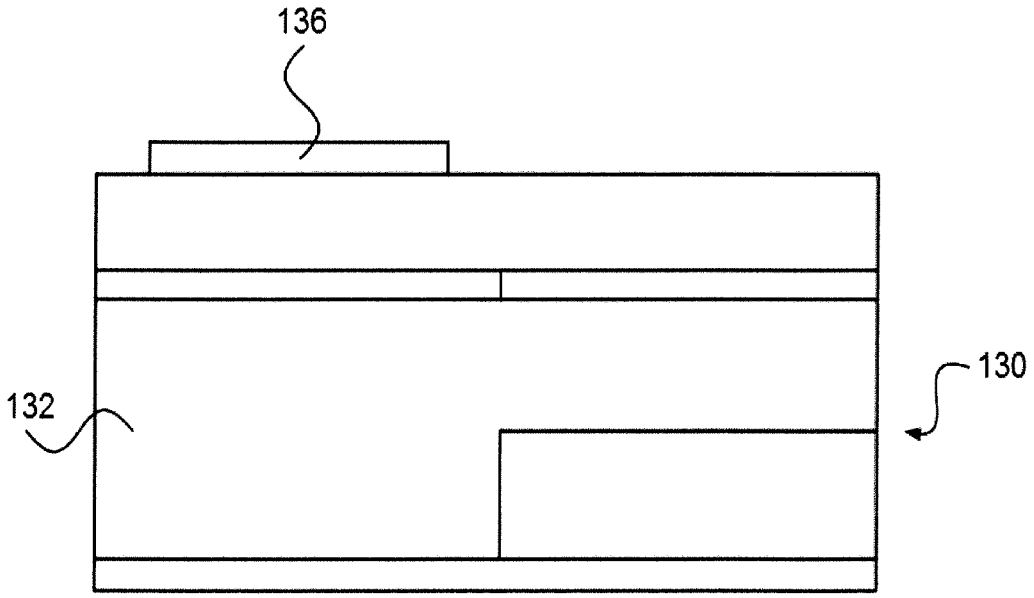
FIG. 8B is a schematic partial cross-sectional view of the interposer of FIG. 8A along a portion of a line D-D.

Referring now to FIGS. 8A and 8B, FIG. 8A illustrates an interposer 130 having a cavity 132 configured to include an array antenna feed 134 for a plurality of antennas 136 positioned on top of a substrate (not shown), and FIG. 8B, a partial cross-sectional view of the interposer 130 along a portion of the line D-D, illustrates that the cavity 132 may have a greater depth at a portion below one of the antennas 136. In the embodiment shown, an input antenna 138 is provided in the cavity 132.

Figure 9:
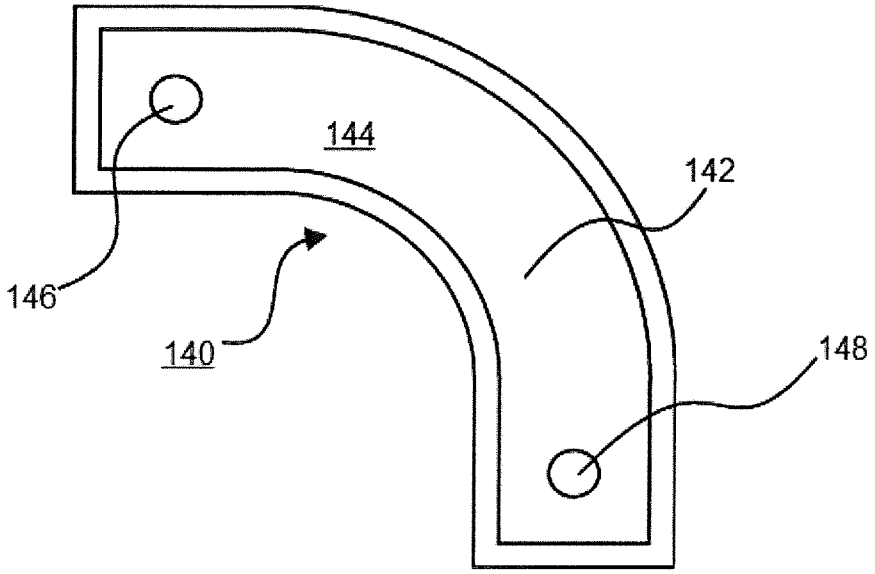
FIG. 9 is a schematic top plan view of an interposer in accordance with still another embodiment of the present invention.

Referring now to FIG. 9, an interposer 140 having a bend 142 provided in the waveguide 144 is shown. Advantageously, provision of the bend 142 in the waveguide 144 allows for a change of direction of the electromagnetic waves that propagate through the waveguide 144. In the present embodiment, a bend of 90° is provided in the waveguide 144. Nevertheless, it should be understood by those of ordinary skill in the art that the present invention is not limited by the angle of the bend. In alternative embodiments, a bend of greater or less than 90° may be provided depending on substrate requirements.

Figure 10:
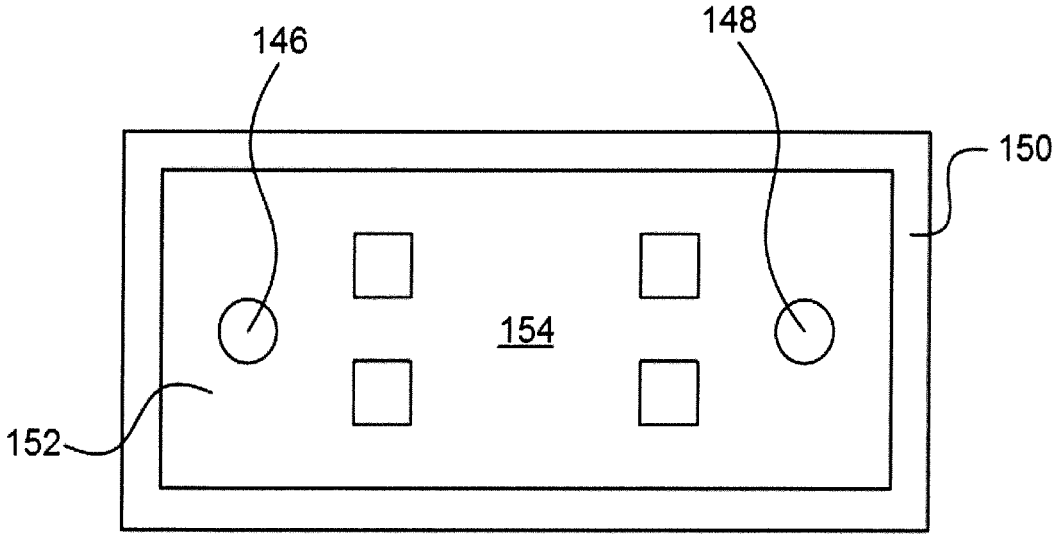
FIG. 10 is a schematic top plan view of an interposer in accordance with another embodiment of the present invention.
Figure 11A:
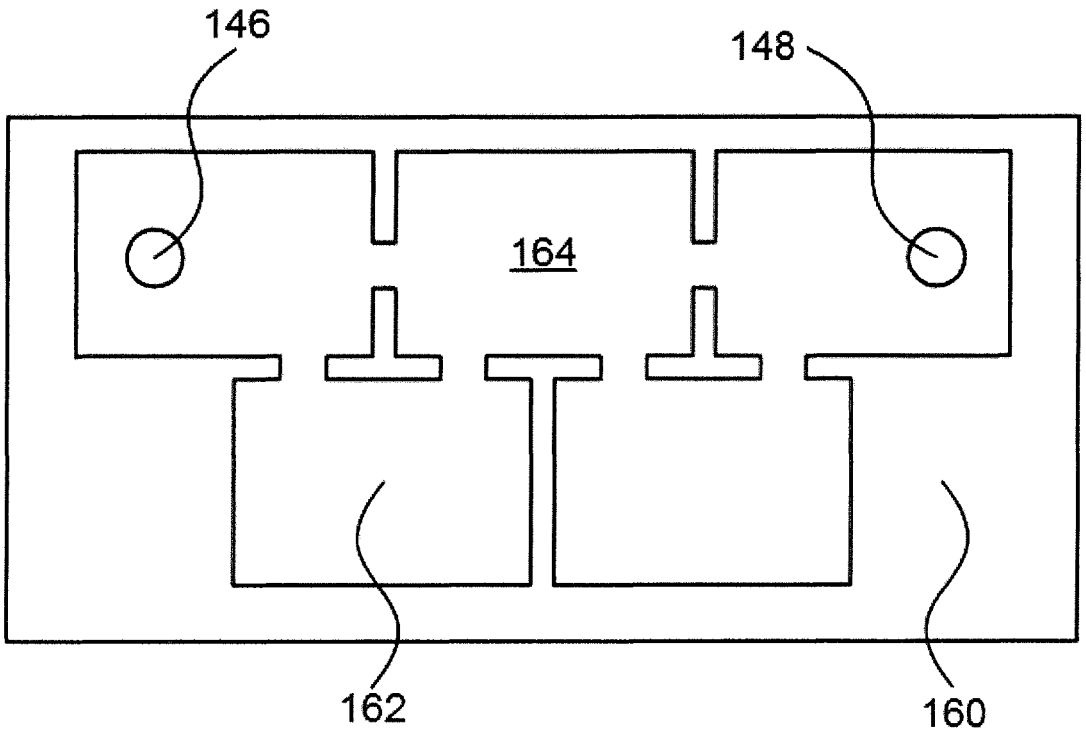
FIGS. 11A and 11B are schematic top plan views of interposers in accordance with other embodiments of the present invention.
Figure 11B:
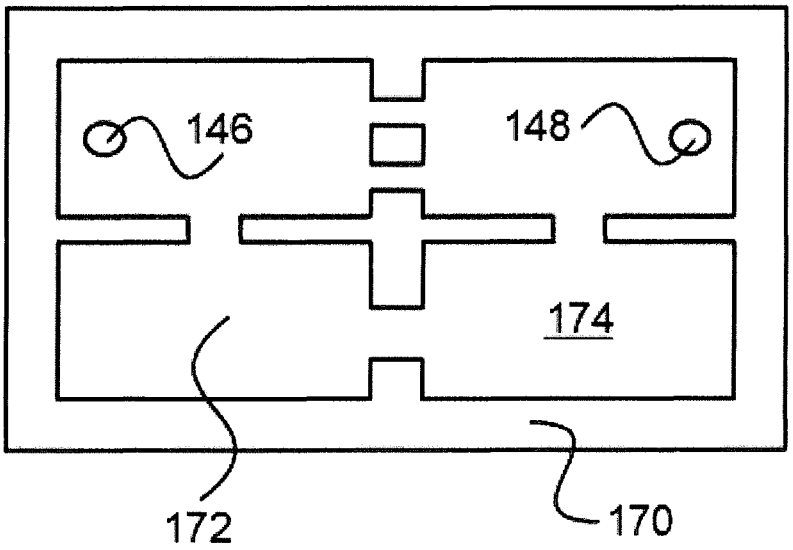
Figure 12:
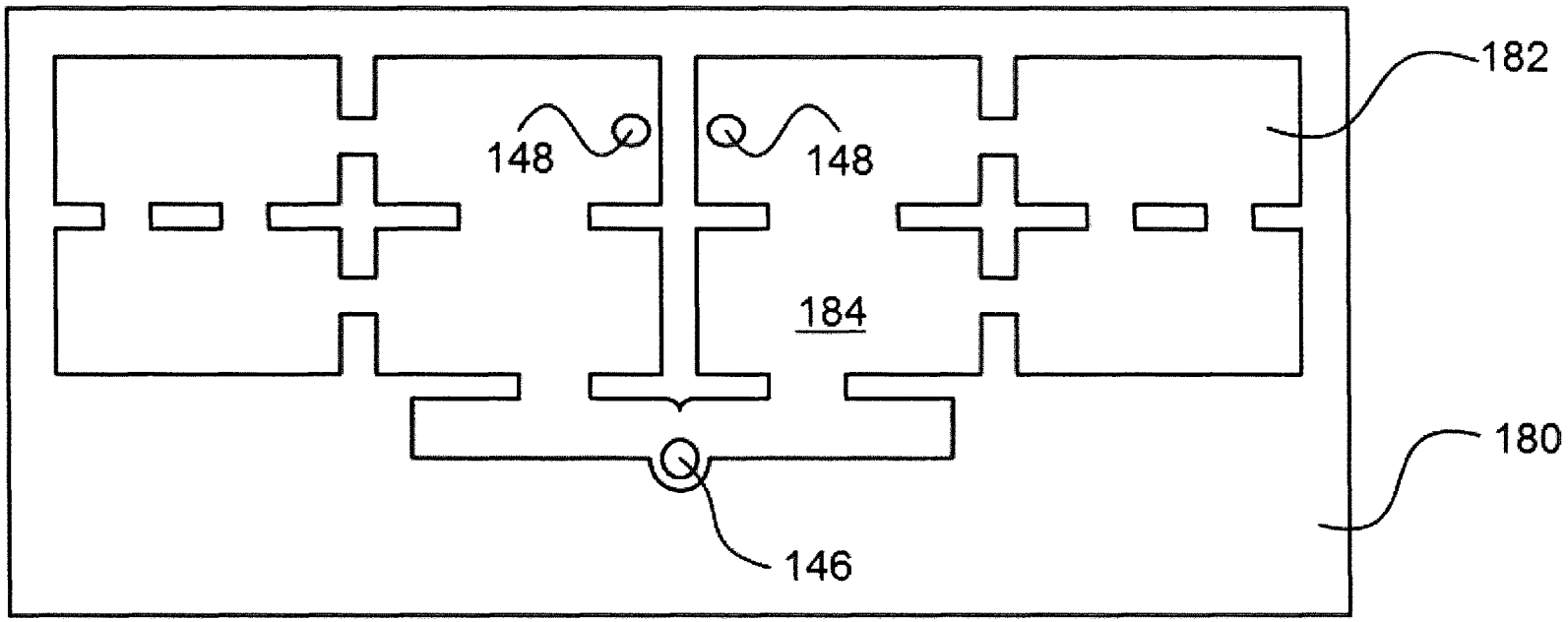
FIG. 12 is a schematic top plan view of an interposer in accordance with yet another embodiment of the present invention.

Referring now to FIGS. 10 through 12, FIG. 10 illustrates an interposer 150 having a cavity 152 configured to include a single cavity filter 154, FIGS. 11A and 11B illustrate interposers 160 and 170 each having a cavity 162 and 172 configured to include a multiple cavity filter 164 and 174, and FIG. 12 illustrates an interposer 180 having a cavity 182 configured to include a filtering multiplexer 184. In each of the embodiments shown in FIGS. 9 through 12, an input antenna 146 and one or more output antennas 148 are provided in the respective cavities 144, 152, 162, 172 and 182. Each of the waveguide 144, the single cavity filter 154, the multiple cavity filters 164 and 174 and the filtering multiplexer 184 may be provided in a single layer of the respective interposers 140, 150, 160, 170 and 180.

Figure 13:
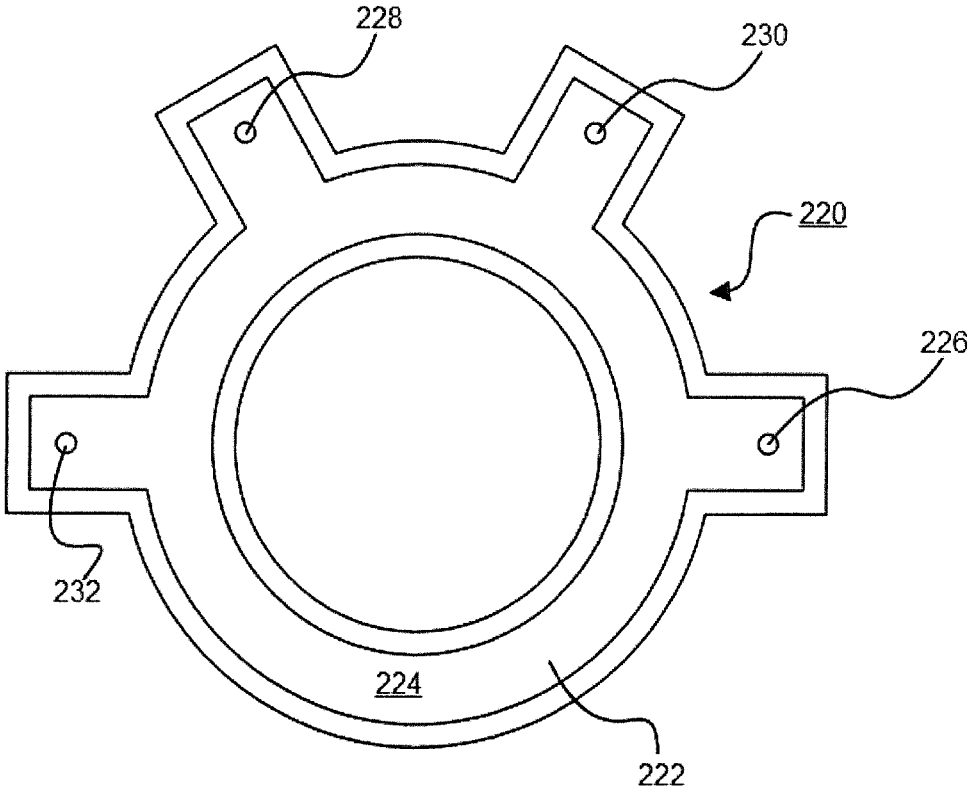
FIG. 13 is a schematic top plan view of an interposer in accordance with still another embodiment of the present invention.

Referring now to FIG. 13, an interposer 220 having a cavity 222 configured to include a hybrid coupler 224 is shown. In the embodiment shown, a first input antenna 226, a second input antenna 228, a first output antenna 230 and a second output antenna 232 are provided in the cavity 222. The first output antenna 230 may be arranged to provide the sum of signals input via the first and second input antennas 226 and 228 and the second output antenna 232 may be arranged to provide the difference between the signals input via the first and second input antennas 226 and 228. As will be understood by persons of ordinary skill in the art, the present invention is not limited by the number or position of the input and output antennas provided in the hybrid coupler 224. The number and position of the input and output antennas of the hybrid coupler 224 are dependent on application requirements. The hybrid coupler 224 may be provided in a single layer of the interposer 220.

Figure 14:
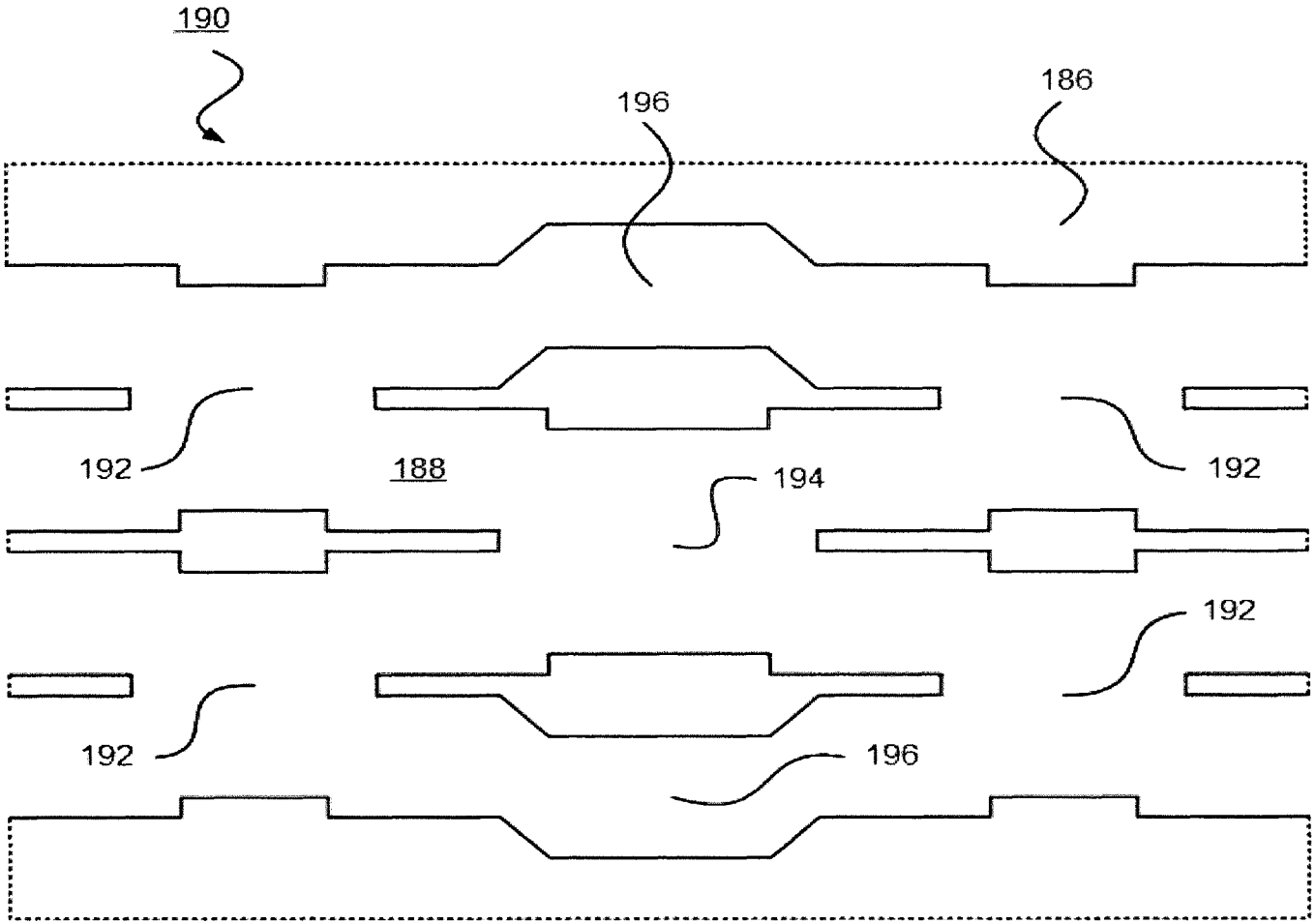
FIG. 14 is a schematic top plan view of a layer of an interposer in accordance with still yet another embodiment of the present invention.

Referring now FIG. 14, an interposer 186 having a cavity 188 configured to include a Butler matrix 190 is shown. The Butler matrix 190 includes a plurality of couplers 192 coupled together by a crossover 194 and a plurality of delay line phase shifters 196. The Butler matrix 190 may be provided in a single layer of the interposer 186.

Figure 15A:
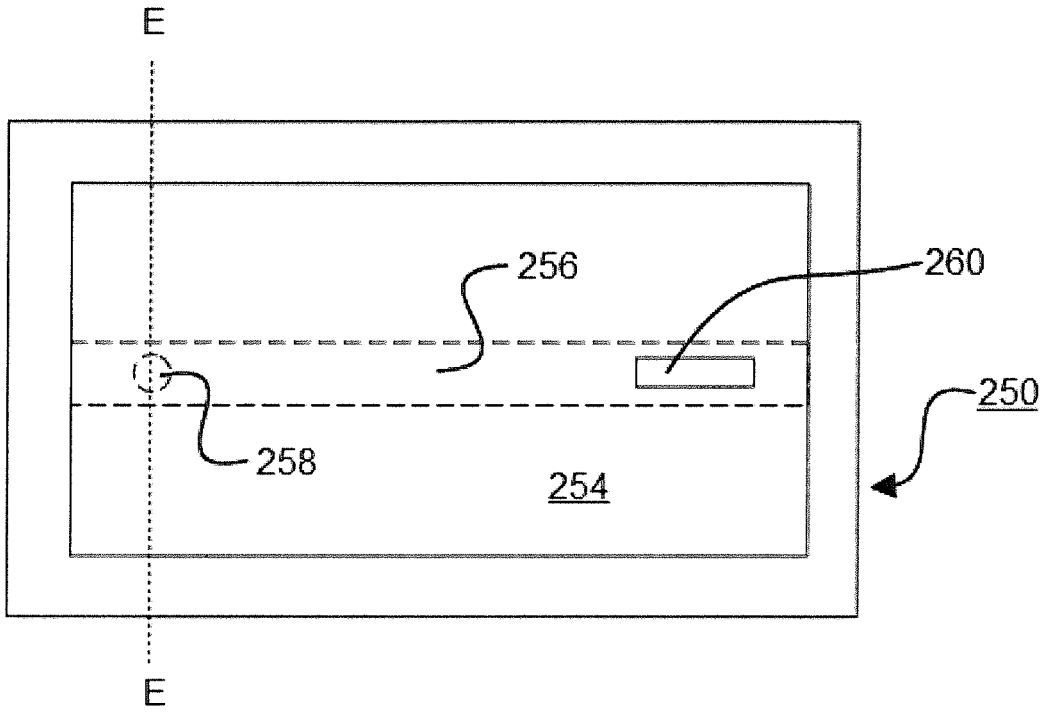
FIG. 15A is a schematic top plan view of a substrate or waveguide structure incorporating an interposer in accordance with another embodiment of the present invention.
Figure 15B:
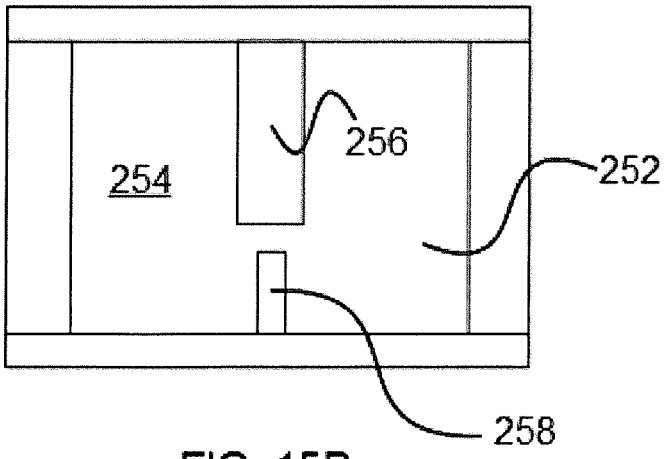
FIG. 15B is a schematic cross-sectional view of the substrate or waveguide structure of FIG. 15A along a line E-E.

Referring now to FIGS. 15A and 15B, an interposer 250 having a cavity 252 configured to include a ridge waveguide 254 is shown. The ridge waveguide 254 of the present embodiment includes a ridge 256 provided in the cavity 252. In the embodiment shown, the interposer 250 is provided with an input antenna 258 in the cavity 252 and an output slot 260. The ridge waveguide 254 may be provided in a single layer of the interposer 250. Although the cavity 252 is shown to have a rectangular cross-section, it should be understood by persons of ordinary skill in the art that the present invention is not limited to a particular cross-sectional shape. In alternative embodiments, the cavity 252 of the ridge waveguide 254 may, for example, be square shaped.

EXAMPLE

Experimental validation of the configuration of a cavity as a waveguide for propagation of electromagnetic waves will now be demonstrated below with reference to FIGS. 16A through 16H.

Figure 16A:
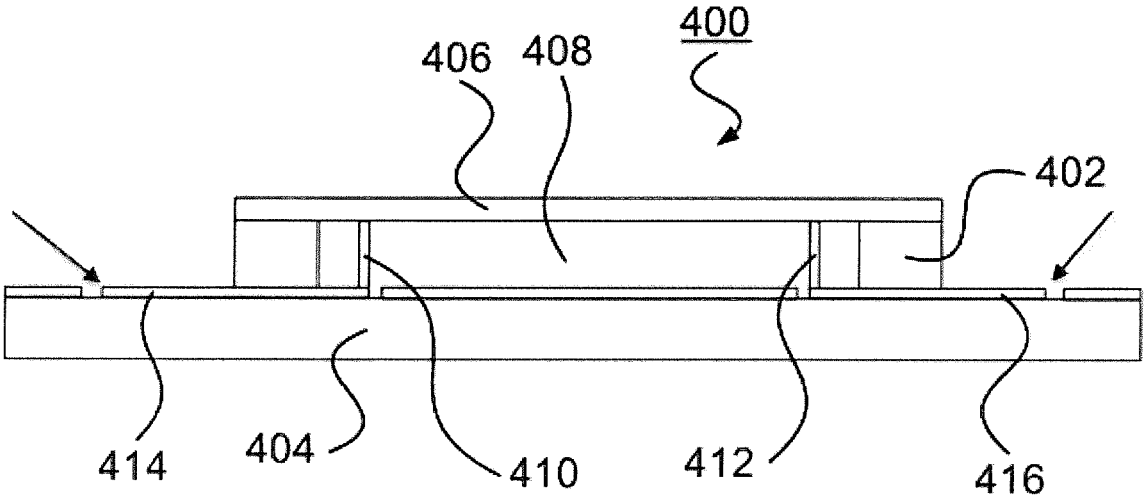
FIG. 16A is a schematic cross-sectional view of a fabricated waveguide structure incorporating an interposer in accordance with yet another embodiment of the present invention.

Referring now to FIG. 16A, a schematic cross-sectional view of a fabricated waveguide structure 400 incorporating an interposer 402 is shown. The fabricated waveguide structure 400 includes a first substrate layer 404, a second substrate layer 406 with the interposer 402 between the first and second substrate layers 404 and 406. In the present embodiment, the interposer 402 is formed of a single layer and a cavity 408 is defined in the layer, the cavity 408 being configured as a waveguide for propagation of electromagnetic waves.

In the embodiment shown, the walls of the interposer 402 are made of vertically aligned carbon nanotubes (CNTs) and a metal cover serves as the second substrate layer 406 enclosing the fabricated waveguide structure 400. The fabricated waveguide structure 400 is fed in and out with first and second probes or excitation pillars 410 and 412 formed of carbon nanotubes that are respectively connected to first and second coplanar waveguide (CPW) access lines 414 and 416 for taking measurements using coplanar probes (not shown). The fabricated waveguide structure 400 has a height of 20 microns (μm) and the first and second probes or excitation pillars 410 and 412 function as antennas.

Figure 16B:
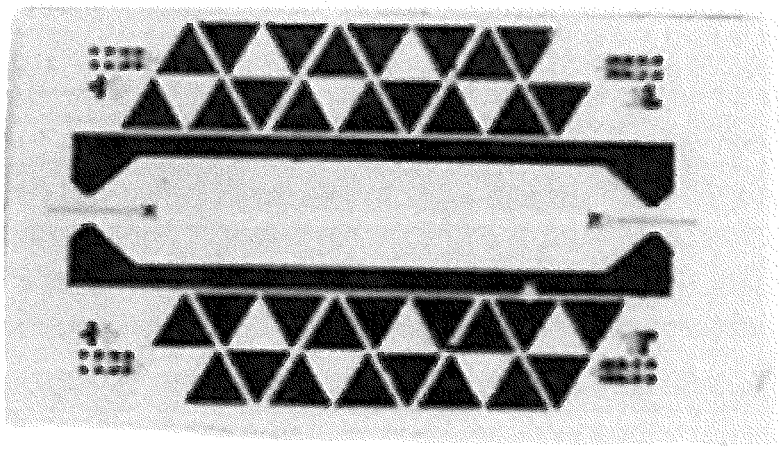
FIG. 16B is an optical image of the fabricated waveguide structure of FIG. 16A.

Referring now to FIG. 16B, an optical image of the fabricated waveguide structure 400 without the metal cover is shown. The black portions are formed of vertically aligned carbon nanotubes, whilst the remaining portions are formed of gold. During operation, the fabricated waveguide structure 400 is closed with the metal cover (not shown).

Figure 16C:
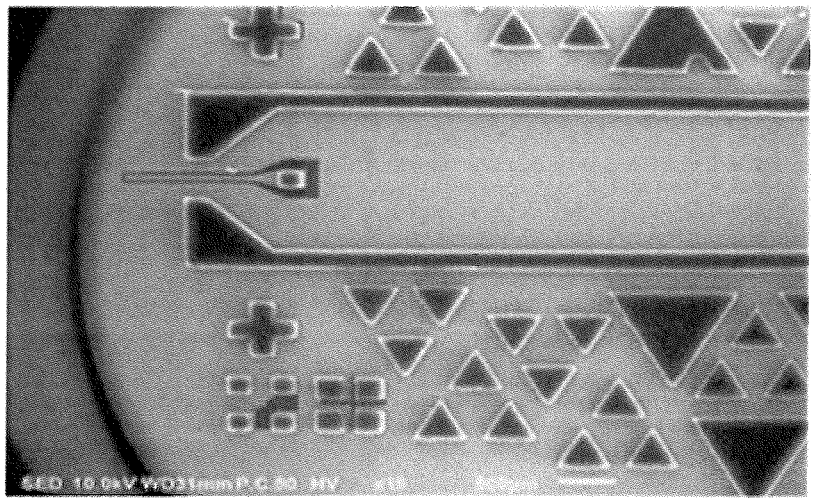
FIGS. 16C through 16F are scanning electron microscope (SEM) images of the fabricated waveguide structure of FIG. 16A.
Figure 16D:
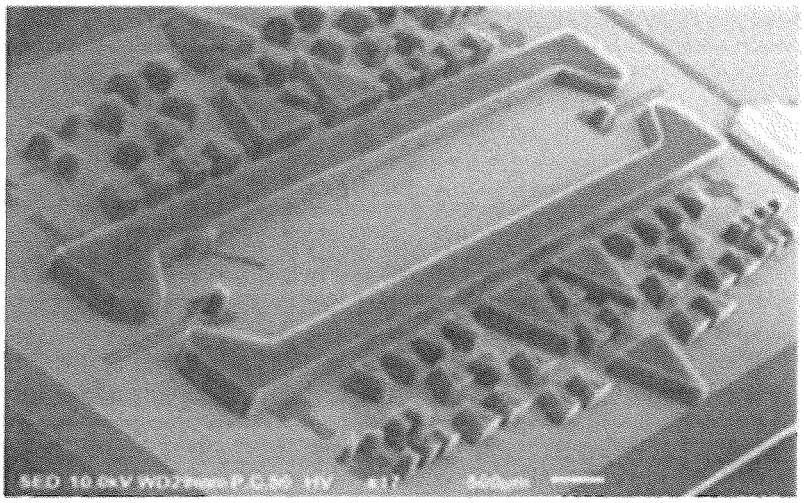
Figure 16E:
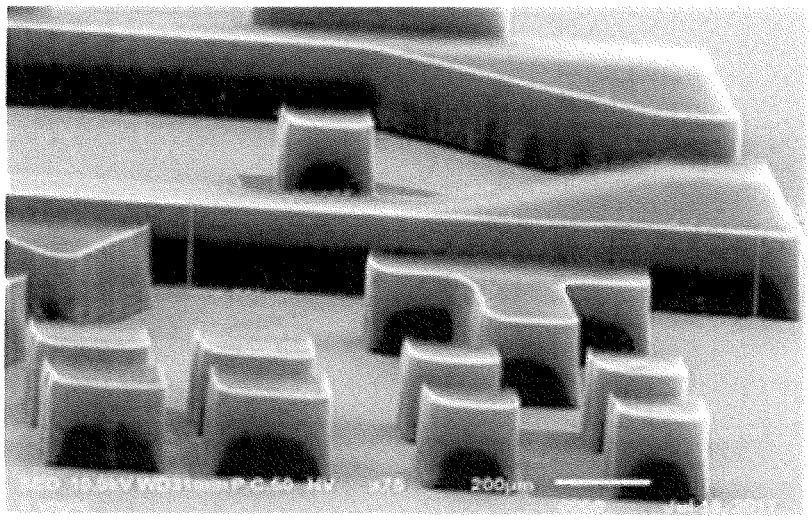
Figure 16F:
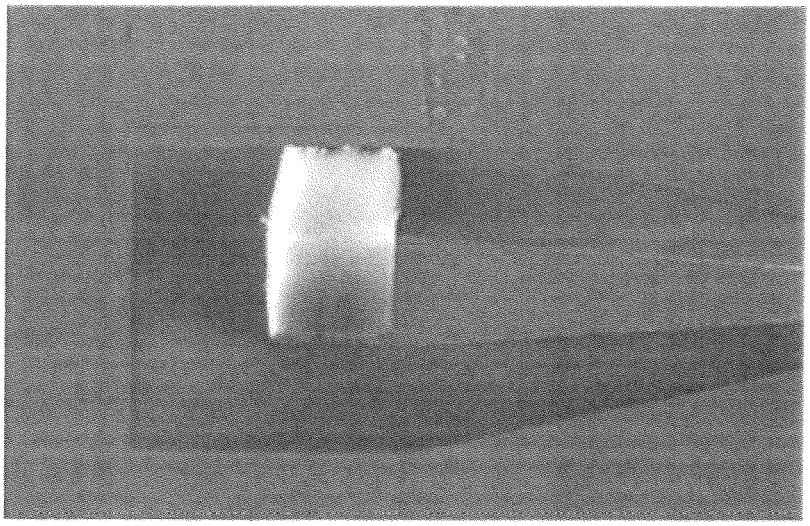

Referring now to FIGS. 16C through 16F, scanning electron microscope (SEM) images of the fabricated waveguide structure 400 are shown. More particularly, FIG. 16C shows a partial top plan view of the fabricated waveguide structure 400 without the metal cover, FIG. 16D shows a perspective view of the fabricated waveguide structure 400 without the metal cover, FIG. 16E shows a further enlarged, partial perspective view of the fabricated waveguide structure 400 without the metal cover, and FIG. 16F shows a further enlarged perspective view of one of the first and second excitation pillars 410 and 412 of the fabricated waveguide structure 400. The excitation pillar 410 or 412 has a height of 210 μm and a width of 200 μm.

Figure 16G:
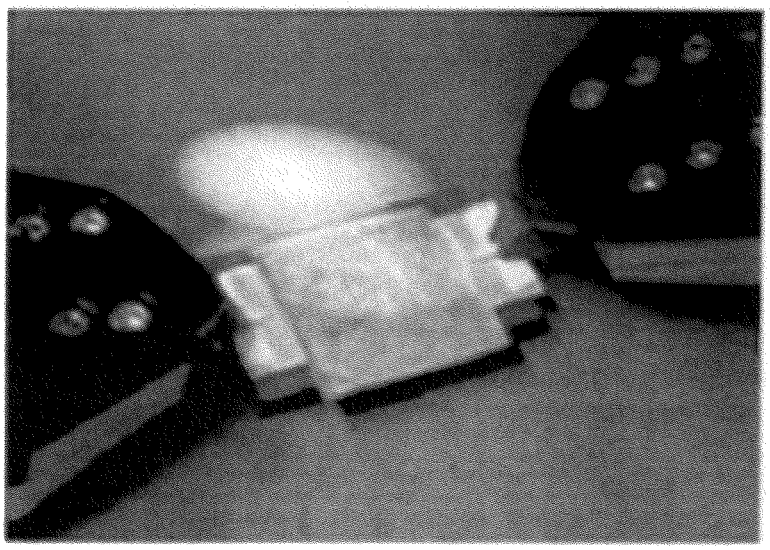
FIG. 16G is a photograph of the fabricated waveguide structure of FIG. 16A undergoing characterization using coplanar waveguide (CPW) probes.

Referring now FIG. 16G, reflection coefficients and transmission coefficients of the fabricated waveguide structure 400 are measured using coplanar waveguide (CPW) probes connected to a Network Vector Analyser (not shown) as shown.

Figure 16H:
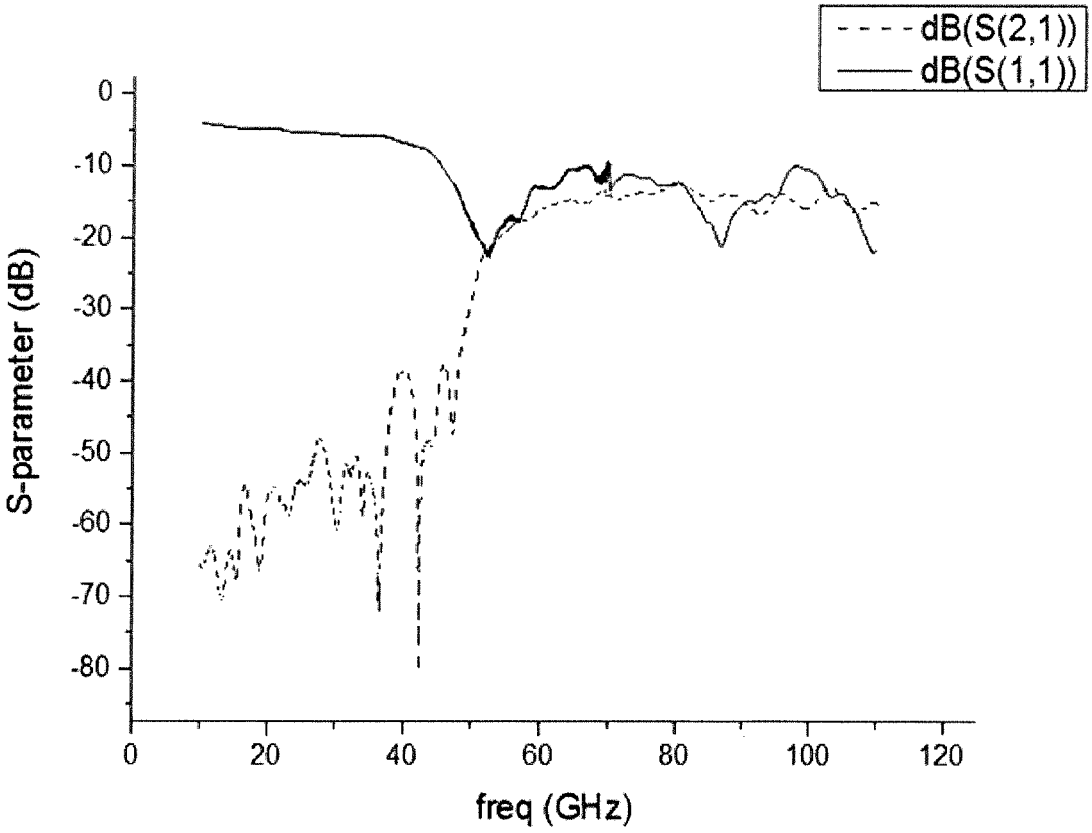
FIG. 16H is a graph of the reflection and transmission coefficients of the fabricated waveguide structure of FIG. 16A.

Referring now to FIG. 16H, the measurements taken (reflection coefficient S(1,1) and transmission coefficient S(2,1)) clearly show waveguide propagation behaviour (high pass filter behaviour) with a cut-off frequency at 50 GHz in accordance with the simulations. This demonstrates that the air cavity 408 can function as a waveguide for propagation of electromagnetic waves and that the probe or excitation pillar 410 or 412 can function as an antenna.

As is evident from the foregoing discussion, the present invention provides an interposer that can alleviate some miniaturisation issues and a method of forming the interposer. With the interposer of the present invention, it is possible to realize a fully packaged system, optimized and personalized to be fitted on a motherboard with other devices such as, for example, active devices, Monolithic Microwave Integrated Circuits (MMIC), micro-electromechanical systems (MEMS), on top of the interposer. The interposer of the present invention is advantageous in that it allows incorporation of one or more microwave functions inside the interposer and the one or more microwave functions incorporated therein are advantageously electromagnetically shielded by the interposer, thereby avoiding radiation losses. Furthermore, because the propagating medium inside the interposer is air, low loss propagation and high quality factors may be achieved. Further advantageously, patterns with different shapes may be easily created inside the interposer to realize various passive microwave functions such as, for example, power coupling, radio frequency duplexing, power splitting, phase shifting and radio frequency filtering using additive manufacturing technologies, micromachining, or nanowire or carbon nanotube growth technologies. Moreover, carbon nanotube and metallic nanowire fabrication methods are low cost and can be used to produce high density nanotubes that are lightweight compared to metallic structures. These may also be used to produce patterns with small dimensions that are difficult to obtain with mechanical machining techniques. This is advantageous for high frequency applications as dimensions of a device decrease with an increase in frequency requirements. In embodiments where the interposer is formed of carbon nanotubes, three-dimensional thermal channelling and thermal dissipation of high powered electromagnetic transmission are enhanced due to the high thermal conductivity of the carbon nanotubes. It is also possible to realise vias with small diameters in such embodiments due to the high aspect ratio of the carbon nanotubes. Additionally, slow-wave technology may be implemented inside the interposer to reduce the dimensional requirements of the interposer by increasing the effective permittivity inside the cavity.

The interposer of the present invention may be used in three dimensional (3D) or heterogeneous integration of microwave devices, particularly in the millimetre wave band (30-300 Gigahertz (GHz)), and may be incorporated in an integrated circuit package such as, for example, a chip-scale-package, a system-in-a-package or a system-on-chip or in a printed circuit board.

While preferred embodiments of the invention have been illustrated and described, it will be clear that the invention is not limited to the described embodiments only. Numerous modifications, changes, variations, substitutions and equivalents will be apparent to those skilled in the art without departing from the scope of the invention as described in the claims.

Further, unless the context clearly requires otherwise, throughout the description and the claims, the words "comprise", "comprising" and the like are to be construed in an inclusive as opposed to an exclusive or exhaustive sense; that is to say, in the sense of "including, but not limited to".

The invention claimed is:

1. An interposer, comprising:

one or more layers, wherein each of the one or more layers is formed only of a plurality of nanostructures; and a cavity defined in the one or more layers, wherein the cavity is configured as a waveguide for propagation of electromagnetic waves.

2. The interposer of claim 1, further comprising a slow-wave structure provided in the one or more layers, the slow-wave structure being in communication with the waveguide.

3. The interposer of claim 2, wherein the slow-wave structure comprises a slot defined in one of the one or more layers.

4. The interposer of claim 1, wherein the cavity is configured to comprise one or more of a splitter, a coupler, an antenna feed, a filter, a phase shifter and a crossover.

5. The interposer of claim 3, wherein the cavity is configured to comprise one of a Y-splitter, a four-way coupler, an array antenna feed, a single cavity filter, a multiple cavity filter, a filtering multiplexer, a delay line phase shifter, a Butler matrix, a hybrid coupler and a ridge waveguide.

6. The interposer of claim 1, wherein a bend is provided in the waveguide.

7. The interposer of claim 1, wherein the nanostructures are elongate in shape and are arranged in parallel orientation to one another in each of the one or more layers.

8. The interposer of claim 7, wherein a height of the nanostructures in each layer corresponds to a thickness of the each layer.

9. The interposer of claim 1, further comprising an antenna provided in the cavity.

10. The interposer of claim 9, wherein the antenna is one of an excitation pillar, a slot, a planar antenna, and a coaxial antenna.

11. A substrate, comprising:

a first substrate layer;

a second substrate layer; and an interposer in accordance with claim 1 between the first and second substrate layers.

* * * * *